US008172096B2

(12) United States Patent
Van De Steen

(10) Patent No.: US 8,172,096 B2
(45) Date of Patent: May 8, 2012

(54) SHELF FOR A SHELVING UNIT

(75) Inventor: Piet Van De Steen, Antwerp (BE)

(73) Assignee: Thoth NV, Antwerp (BE)

( * ) Notice: Subject to any disclaimer, the term of this patent is extended or adjusted under 35 U.S.C. 154(b) by 376 days.

(21) Appl. No.: 12/376,092

(22) PCT Filed: Jul. 31, 2007

(86) PCT No.: PCT/EP2007/006755
§ 371 (c)(1),
(2), (4) Date: Mar. 27, 2009

(87) PCT Pub. No.: WO2008/014969
PCT Pub. Date: Feb. 7, 2008

(65) Prior Publication Data

US 2010/0006519 A1 Jan. 14, 2010

(30) Foreign Application Priority Data

Aug. 3, 2006 (EP) ..... 06016195

(51) Int. Cl.
*A47G 29/087* (2006.01)

(52) U.S. Cl. ..... 211/119.003

(58) Field of Classification Search ..... 211/119.003, 211/184, 94.01, 57.1, 123, 135, 59.1; 40/651
See application file for complete search history.

(56) References Cited

U.S. PATENT DOCUMENTS 2,639,040 A * 5/1953 Tapley ..... 211/119.003
3,081,882 A * 3/1963 Magnuson ..... 211/119.003
3,084,463 A * 4/1963 Guyer et al. ..... 40/564
3,086,308 A * 4/1963 Ternouth ..... 40/541
3,248,494 A * 4/1966 Barnes ..... 200/51 R
3,320,690 A * 5/1967 Forsburg ..... 40/650
3,620,376 A * 11/1971 Gingher ..... 211/123
3,949,880 A * 4/1976 Fortunato ..... 211/119.003
4,698,928 A * 10/1987 Soporowski ..... 40/651
4,866,868 A * 9/1989 Kass ..... 40/661
5,220,739 A * 6/1993 Chich et al. ..... 40/564
5,924,367 A * 7/1999 Henke et al. ..... 108/108
6,026,603 A * 2/2000 Kump et al. ..... 40/661.03
6,126,125 A * 10/2000 Dalton ..... 248/205.2
6,226,910 B1 * 5/2001 Ireland ..... 40/661.03

(Continued)

FOREIGN PATENT DOCUMENTS

DE 10 2004 006273 A1 8/2005

(Continued)

OTHER PUBLICATIONS

Examination Report of EPO regarding European Patent Application No. 07 786 452.8, Nov. 23, 2010.

(Continued)

*Primary Examiner* — Sarah Purol

(74) *Attorney, Agent, or Firm* — Bacon & Thomas, PLLC

(57) ABSTRACT

A sheet metal shelf has a front edge, a back edge and a load carrying flat portion, the front edge comprising a support for supporting display elements of a display system. The sheet material at the front edge is formed as a first enclosed channel integrally formed with the load carrying flat portion, so the channel provides the support at the front edge of the shelf. The support has apertures for attaching the display elements.

21 Claims, 19 Drawing Sheets

U.S. PATENT DOCUMENTS

| | | | | |
|---|---|---|---|---|
| 6,321,475 | B1 * | 11/2001 | Glanz | 40/661 |
| 6,481,133 | B1 * | 11/2002 | DeSena | 40/661.03 |
| 6,508,566 | B1 | 1/2003 | Roorda | |
| 6,568,112 | B2 * | 5/2003 | Lowry et al. | 40/661.03 |
| 6,688,567 | B2 * | 2/2004 | Fast et al. | 248/220.41 |
| 6,802,146 | B2 * | 10/2004 | Gay | 40/651 |
| 6,932,226 | B2 * | 8/2005 | Hardy | 211/119.003 |
| 6,935,060 | B2 * | 8/2005 | Bjerke et al. | 40/661.03 |
| 6,935,061 | B2 * | 8/2005 | Thompson | 40/661.03 |
| 6,971,201 | B2 * | 12/2005 | Brinkman et al. | 40/642.02 |
| 7,055,274 | B2 * | 6/2006 | Fast et al. | 40/661.03 |
| 7,299,579 | B2 * | 11/2007 | Lowry | 40/661.03 |
| 7,325,348 | B2 * | 2/2008 | Mueller et al. | 40/649 |
| 7,386,950 | B2 * | 6/2008 | Fast et al. | 40/661.03 |
| 7,574,822 | B1 * | 8/2009 | Moore | 40/661.03 |
| 7,740,144 | B2 * | 6/2010 | Kosir | 211/119.003 |
| 7,882,969 | B2 * | 2/2011 | Gerstner et al. | 211/119.003 |
| 2002/0147597 | A1 * | 10/2002 | Connors et al. | 705/1 |
| 2003/0178384 | A1 * | 9/2003 | Speed | 211/119.003 |
| 2004/0200793 | A1 * | 10/2004 | Hardy | 211/119.003 |
| 2005/0035075 | A1 * | 2/2005 | Walker | 211/119.003 |
| 2005/0139560 | A1 * | 6/2005 | Whiteside et al. | 211/119.003 |
| 2006/0076303 | A1 * | 4/2006 | Scholen et al. | 211/85.7 |
| 2009/0001037 | A1 * | 1/2009 | Wilcock | 211/119.003 |

FOREIGN PATENT DOCUMENTS

| | | |
|---|---|---|
| GB | 912661 | 12/1962 |
| GB | 2356494 A | 5/2001 |

OTHER PUBLICATIONS

Communication from the China State Intellectual Property Office regarding Chinese Patent Application No. 200780036549.4, Jul. 26, 2010.

* cited by examiner

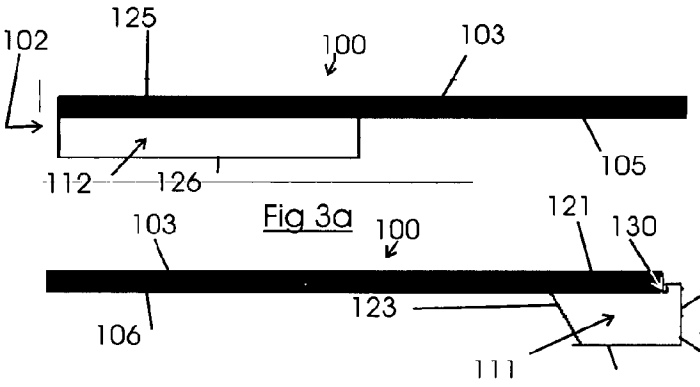
Fig 3a
Fig 3b
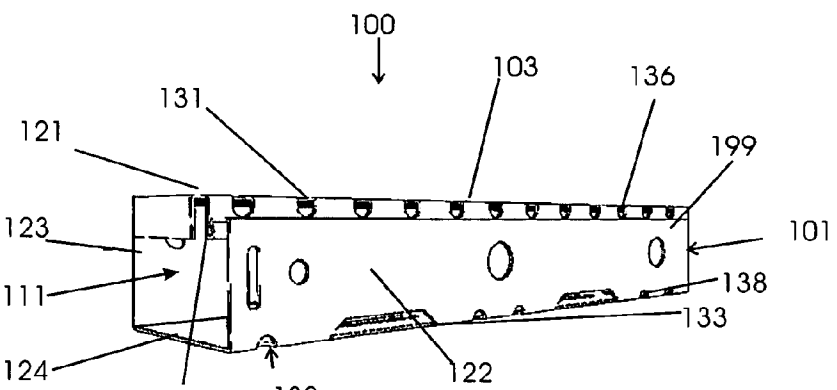
Fig 4
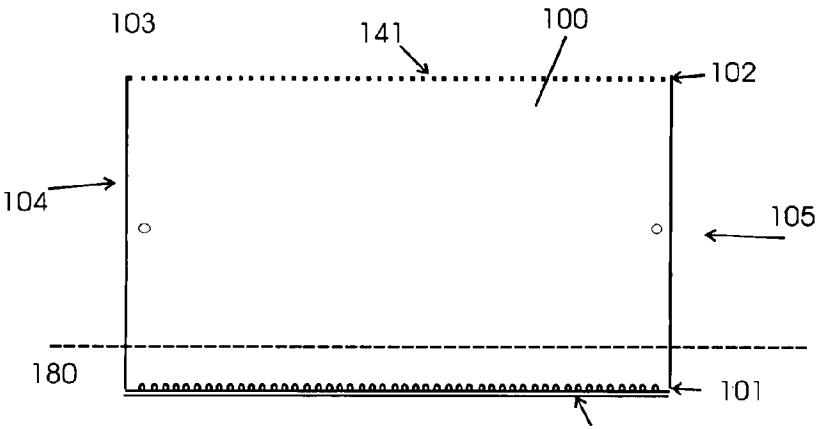
Fig 2
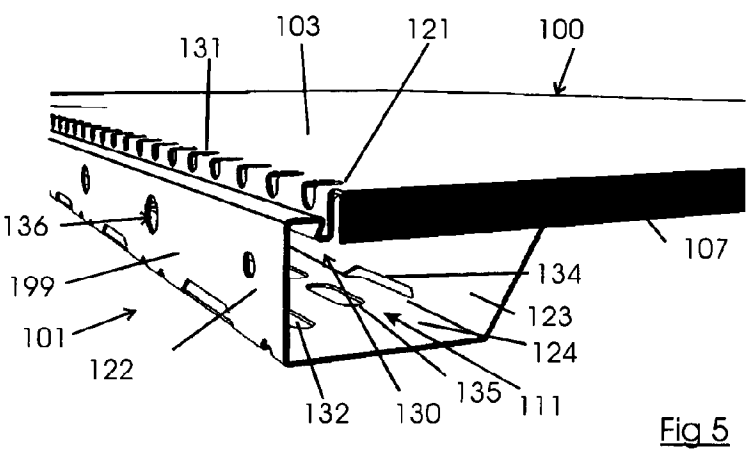
Fig 5

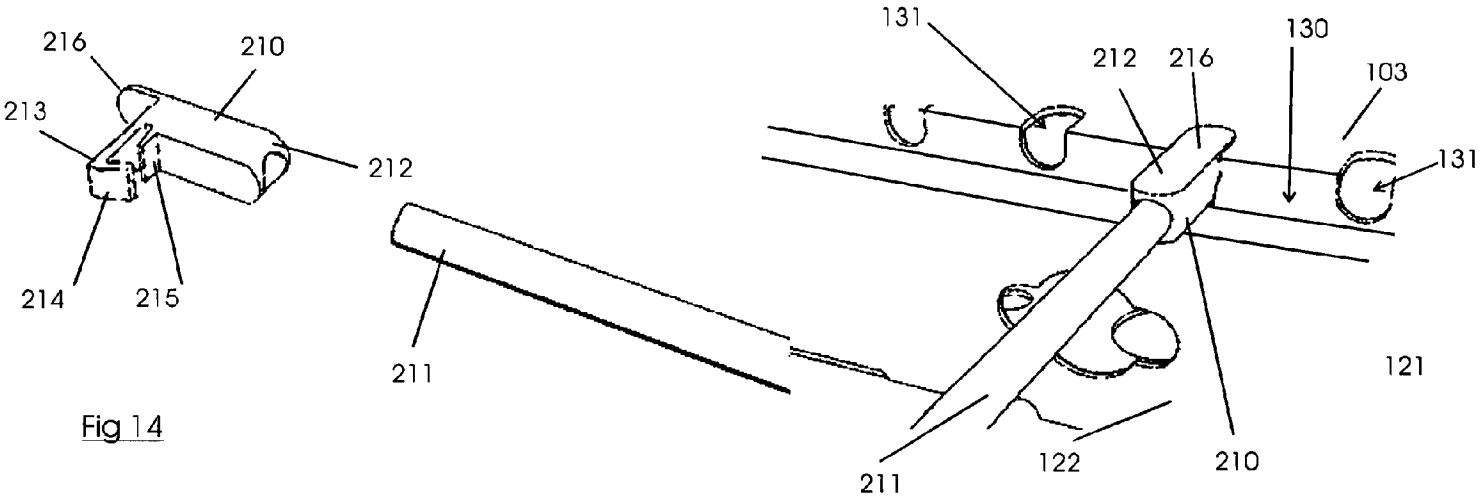
Fig 14
Fig 15
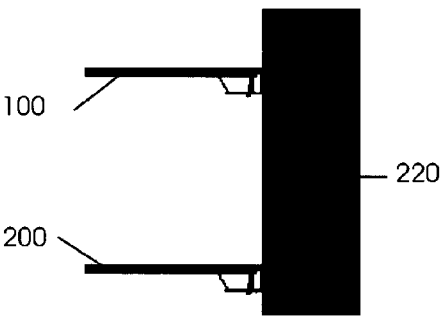
Fig 21
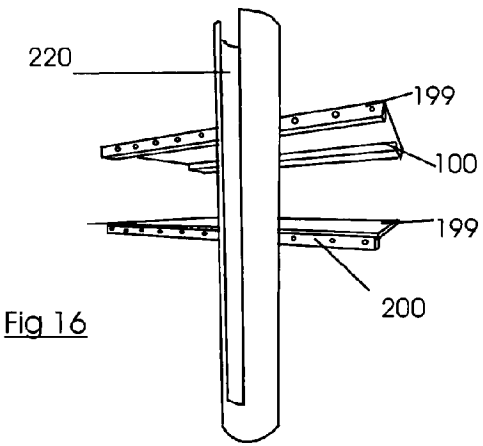
Fig 16

SHELF FOR A SHELVING UNIT

TECHNICAL FIELD OF THE INVENTION

The present invention relates to shelving units and more particularly to shelves for shelving units being provided with support for display elements of a display system. The support is used to attach all kinds of materials and display elements, also called Point-of-Sale (POS) materials, e.g. in stores and shopping aisles of shops, supermarkets or stores. The invention further relates to methods of making such shelving units and the methods to fix display elements such as Point-of-Sale (POS) materials to the shelving unit.

BACKGROUND OF THE INVENTION

At present, in supermarkets and stores and the like, a multitude of information on product is displayed on the edge of the shelving units bearing the products. The mass production shelving units used in these stores have been designed with minimal communication options, limited to the display of the price of the product, e.g. by means of a data strip.

The shelving units are also used to carry additional materials for attracting the attention of potential consumers. These materials or display elements, i.e. Point-of-Sale (POS) materials include any item that is used to communicate or highlight a product, a product feature or a promotion and comprise various items, such as banners, wobblers, flags, or even samples of the products itself. They also include front shelf extensions for increased product visibility and all sorts of illumination or electronic devices to provide information on the product exposed, such as LCD-screens and the like. In order to fix all these additional elements to the shelving unit, various supports, such as adaptors have been developed, ranging from clamps and screws to magnets, which are to be mounted to the shelving unit. This mounting is usually done by bolts and nuts, or by means of snap fit connections.

As the shelving units have not been designed to hold POS-materials, these adaptors have some major disadvantages. All objects fixed to the supports in the form of an adaptor, as well as the adaptor itself, can be fairly easily knocked off the shelving unit by persons accidentally hitting the object or the adaptor itself when passing through the aisle. The object or even the adaptor can be damaged to a too large extent, which prevents reinstallation or reuse. Also as the supports can be disconnected, unauthorised persons may displace or remove the supports and/or the objects fixed to it. Such damage or removal becomes especially important as the objects become more complex and expensive. In addition, the integration of light and other electrical devices in maladjusted shelving units may be a source of major threats to consumers e.g. children such as electrocution and retailers such as short circuit and fire hazard and alike.

SUMMARY OF THE INVENTION

It is an object of the present invention to provide good shelving units, which at least partially overcome the drawbacks of presently known shelving units. The shelving units according to the present invention accomplish this objective.

According to a first aspect of the present invention, a shelf for a shelving unit is provided. The shelf is an advertising display shelf for carrying products and items for display, and is made of sheet material. The shelf has a front edge, a back edge and a load carrying flat portion in between the front and back edges. The advertising display shelf is adapted for displaying advertising material on the front edge thereof. The front edge may include the top, front and/or the bottom of the front edge. Advertising material may be displayed over the whole length of the front edge of the shelf or over a major part of the front of the shelf, e.g. at least 70%, or at least 80% or at least 90% of the length of the front of the shelf. The front edge comprises a support for supporting display elements of a display system. The sheet material at the front edge is formed as a first enclosed channel integrally formed with the load carrying flat portion, i.e. made out of one piece with the load carrying flat portion, and the channel provides the support at the front edge of the shelf. The channel may provide a front edge, a top and a bottom, and these may be used as the front edge of the shelf. The channel may be integrally formed with the load carrying portion by folding the sheet material. Alternatively, the channel may be integrally formed with the load carrying portion by forming the sheet material. The channel may extend over a majority of the front of the shelf, e.g. over at least 70%, or at least 80% or at least 90% of the length of the front of the shelf.

A shelf according to the first aspect of the present invention, has the advantage that the support is an integral part of the shelf, which reduces the risk of parts of the shelf, and thus of the shelving unit in which the shelf is used, being accidentally knocked off by the general public. Additionally the enclosed channel provides increased rigidity to the shelf, and thus to the shelving unit as a whole. It also has the advantage that the inner space of the enclosed channel is protected from harmful influences of external objects, e.g. spilled products on the shelf. The channel is not accessible for the general public and thus barred from external, unauthorised manipulation by the general public. The general public can't touch the elements or components, as they don't have entrance to the enclosed channel. The latter is especially the case when electrical elements are provided inside the first enclosed channel, which elements are to control e.g. touch screens, illumination of the products displayed on the shelf, presence detection of products displayed on the shelf and many more. The risk on damage provided to the shelving unit as a whole, to the shelf and to the support and optionally its electrical elements in particular is reduced. It also avoids harm caused to the general public itself, which could occur when a person would come into contact with inappropriately shielded electrical components of the display system supported and optionally mounted in or to the support.

As the support is already an integral part of the shelf, the provision of mounting means or fixation points in the form of a pattern of apertures, for example for mounting point-of-purchase advertising elements, such as circular apertures and/or slits, facilitates an easy adaptation of the shelf to the particular requirements or needs when the shelf is used or reused to display a particular product or is used to display products in a particular location. The pattern of apertures may be adapted for allowing the full length of the front edge of the shelf to be used for mounting a plenitude of materials. The pattern of apertures may be a regular or an irregular pattern. The pattern of apertures allows mounting different display elements in different combinations, e.g. over the full length of the front edge shelf. The apertures may have a shape so that the display elements are interchangeable, i.e. can take each other's place.

According to embodiments of the present invention, the support may have apertures for mounting Point-of-Sale (POS) materials or advertising elements. In a shelf according to embodiments of the present invention, the apertures may be adapted for mounting one or more display elements from the group consisting of a wobbler, a label, a product holder, a side banner, a flag, a sign, an electronic price tag, a shelf divider, a shelf extender, a shelf talker, an aisle divider, a touch screen display, an LCD screen, an electronic devices and an electronic bascules. Some or each of the apertures can be used to mount different display elements at the choice of the user. The display elements may be interchangeably connectable to the shelf.

According to embodiments of the present invention, the mounting means or fixation points may be apertures. These apertures may have any suitable shape. They may be adapted to receive and/or guide fixation parts of display elements having a corresponding or fitting shape, for connection to the shelf. As examples only, the apertures may be longitudinal slits, circular openings, circular openings having a slit at one side, circular openings having two axially opposed slits. The apertures may be substantially equally spaced in longitudinal direction of the front edge. Alternatively, the apertures may be provided at pre-determined but unequally spaced locations in the front edge.

The apertures may be provided in the front side, the top of the bottom of the channel by any suitable means. As an example, a bar, e.g. a steel bar, could be put through the first enclosed channel, and dies could be inserted into this bar, after which the apertures can be made in the front side of the channel by using this in a press. As an alternative example, laser cutting may be used. Such laser cutting may be carried out while the sheet material is still flat, i.e. before the channel is integrally formed with the load carrying portion.

According to embodiments of the present invention, the first enclosed channel may be provided with at least one electrical conductor. In embodiments of the present invention, the first enclosed channel has an inner void, and the at least one electrical conductor may be provided inside the inner void.

These embodiments have the advantage that the conductor strip is protected from external objects and inappropriate manipulation during use of the shelving unit comprising at least one shelf as subject of the present invention, as the conductor strip is enclosed by the first enclosed channel.

The at least one electrical conductor can for example be a power cable which may be used to conduct power to devices mounted or attached to the shelf, e.g. to lamps for illuminating items stored on the shelf. Alternatively, the conductor can be a signal cable which may be used to conduct other electronic signals, e.g. data signals, to appliances mounted or attached to the shelf, e.g. for visualising data about the items stored on the shelf, such as for example price of these items.

The electrical conductor may be embedded in an electrically insulating material, thus forming a conductor strip.

According to embodiments of the present invention, the first enclosed channel has an inner void, which is electrostatically screened or electrostatically shielded by the sheet material.

Such shelves have the advantage that electrical components or elements inside the first channel are partially or totally shielded from influence by EMI and/or electrostatic charges which can build up on the shelving unit in which the shelf is used, which electrostatic charges may be provided by friction between the shelving unit and persons passing the shelving unit.

According to embodiments of the present invention, the sheet material at the back edge may be formed as a second enclosed channel.

Similarly to the first enclosed channel, next to improvement of the rigidity of the back edge, the shelf and the shelving unit as a whole, this second enclosed channel can be used to house electrical or other elements which are used to control and/or display products, without having these elements being exposed to the general public.

According to embodiments of the present invention, optionally the second enclosed channel may have mounting means or fixation points, e.g. apertures, for mounting Point-of-Sale (POS) materials. This has the advantage that, optionally in combination with the apertures of the first channel, more flexibility for adapting the shelf is obtained. Hence, more flexibility is obtained for adapting the shelving unit in which the shelf is used, to particular needs for displaying products in given circumstances or locations. The additional mounting means or fixation points at the back edge of the shelf offers improved safety to consumers. In case of too heavy POS material, when using front fixation alone, the shelf could tilt towards consumers as products are moved or taken away so the original weight distribution changes which perturbs the equilibrium of the shelf and optionally the shelf unit. This is avoided by also using mounting means or fixation points at the second channel. Also the mounting means or fixation points of the second enclosed channel may be a plurality of apertures. These apertures may have any suitable shape. They may be adapted to receive fixation parts of display elements having a corresponding or fitting shape, for connection to the shelf. As examples only, the apertures may be longitudinal slits, circular openings, circular openings having a slit at one side, circular openings having two axially opposed slits. The apertures may be substantially equally spaced in longitudinal direction of the second channel. Alternatively, the apertures may be provided at pre-determined but unequally spaced locations in the second channel. The apertures may form a regular or irregular pattern at the back edge of the shelf.

According to embodiments of the present invention, the first enclosed channel may have at least a first side being part of the load carrying flat portion, a second side providing the front side of the support and a third side facing towards the back edge of the shelf.

A cross-section according to a plane substantially perpendicular to the longitudinal direction of the shelf shows better the relationship between the sides of the first channel. The cross-section may be substantially polygonal, either regular or irregular, preferably a substantially convex polygon, more preferred a quadrangle such as a substantially convex quadrangle. The polygon may have a first side, which first side is a part of the shelf and can be used as a part of the shelf to display and carry the load of products being displayed on the shelf by means of the load carrying flat portion. The second side of the polygon is integrally made with the first side, i.e. indissolubly and unalterably coupled to the first side. As it provides the front side of the support, the support is always provided in the same way, e.g. the front side of the support is provided under the same angle as compared to the first side, i.e. the shelf. This provides the possibility to couple all or any combination of display elements of a display system, being display elements such as POS material, i.e. objects like a wobbler, a label, a product holder, a side banner, a flag, an electronic price tag, a sign, a shelf divider, a shelf extender and similar objects in a more compact fitting way, thus providing more reliable fitting and an aesthetically appearance. The third side faces to the back edge of the shelf, so inwards the shelf unit in which the shelf is used, and can be used to e.g. provide illumination in the shelf unit between two shelves one positioned above the other.

According to embodiments of the present invention, the cross-section may be substantially quadrangular and having a fourth side being substantially parallel with the first side.

This has the advantage that the stability of the shelf, and thus the shelving unit in which it is used, is further improved. The fourth side facing downwards away from the shelf can also be used as basis for coupling a first side of a reinforcing element, e.g. a bar or plate, to the front edge of the shelf and the shelving unit in which it is used. The reinforcing elements may be coupled at their second side to the back edge of the shelf or optionally to the side of the second enclosed channel present at the back edge of the shelf. The additional mounting means or fixation points at the back edge of the shelf offers improved safety to consumers. In case of too heavy POS material, when using front fixation alone, the shelf could tilt towards consumers as products are moved or taken away so the original weight distribution changes which perturbs the equilibrium of the shelf and optionally the shelf unit.

According to embodiments of the present invention, at least one of the second and third sides of the first enclosed channel may be in contact with a conductor strip, the conductor strip comprising at least one electrical conductor embedded in an electrically insulating material, the conductor strip being provided in the first enclosed channel. The conductor strip may be attached, e.g. glued or screw mounted, to any of the sides of the enclosed channel.

According to embodiments of the present invention, the at least one of the second and third sides of the first enclosed channel may be provided with a plurality of apertures, the conductor strip comprising at least one socket positioned at an aperture for allowing coupling of an electronic device to the at least one electrical conductor. The electronic device may be positioned at the exterior of the first enclosed channel, while the at least one electrical conductor may be positioned at the interior of the enclosed channel.

Shelves having such features have the advantage that they facilitate the provision of electronic devices such as lamps, or other illumination, displays, such as LCD displays, for providing product information, electronic balances and many more, in a fast and easy way by allowing simple plugging in of the electrical elements into the preformed sockets. Via these sockets, alternating current, e.g. 220V or direct current, e.g. 12V or 24V can be provided to charge the electronic devices. Additionally or alternatively, data information can be provided to the electronic devices via conductors in the conductor strip.

According to embodiments of the present invention, the conductor strip may make contact with the inner surface of the at least one of the second and third sides of the first enclosed channel. Optionally, the conductor strip may be screw mounted.

The contact between the conductor strip and the side has the advantage that the conductor strip is supported by one of the sides of the channel, which provides improved mechanical strength to the strip.

According to embodiments of the present invention, along the front edge, the sheet material may be provided with at least one ridge for providing a snap fit to a datastrip along the front side of the support.

The provision of such ridge has the advantage that presently commonly used means to provide information about the products displayed on the shelf can be used, while the support still is an integral part of the shelf, providing improved stability and preventing accidentally knocking off of the display elements of the display system and/or knocking off of the support itself by general public.

According to a second aspect of the present invention, a shelving unit is provided comprising at least one shelf according to the first aspect of the present invention.

A shelving unit according to embodiments of the present invention may furthermore comprise at least one interchangeably connectable display element, e.g. an active or a passive point-of-purchase advertising element, mounted at one of the mounting means of one of the advertising display shelves of the shelving unit. With "interchangeably connectable" is meant that the display element can be mounted on another location, e.g. mounted in another mounting means, or that two display elements can take each other's place.

According to a third aspect of the present invention, a method is provided for manufacturing an advertising display shelf suitable for carrying products on the shelf and for displaying display elements on the front edge. The method comprises providing sheet material and forming from the sheet material a front edge and a load carrying flat portion of the advertising display shelf, the front edge comprising a support for supporting display elements. Forming the front edge comprises integrally forming with the load carrying flat portion a first enclosed channel and providing in the front edge a pattern of apertures for attaching the display elements.

Providing mounting means may comprise making apertures in the front edge. Making such apertures may comprise laser cutting or die-cutting such apertures, for example before the first enclosed channel is formed, while the sheet material is still flat. The apertures may be laser cut in locations of the sheet material which will form the front, the top and/or the bottom of the first enclosed channel.

Particular and preferred aspects of the invention are set out in the accompanying independent and dependent claims. Features from the dependent claims may be combined with features of the independent claims and with features of other dependent claims as appropriate and not merely as explicitly set out in the claims.

Although there has been constant improvement, change and evolution of devices in this field, the present concepts are believed to represent substantial new and novel improvements, including departures from prior practices, resulting in the provision of more efficient, stable, reliable and safe devices of this nature.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

BRIEF DESCRIPTION OF THE DRAWINGS

FIG. 2 shows a top view of the shelf of FIG. 1.

FIG. 3*a* is a schematical side view of the back edge of the shelf of FIG. 1, whereas FIG. 3*b* is a schematical side view of the front edge of the shelf of FIG. 1.

FIG. 4, FIG. 5, FIG. 6 and FIG. 7 show detailed views of the first enclosed channel at the front edge of shelf of FIG. 1.

FIG. 14 and FIG. 15 show details of this ridge fixation of FIG. 13.

FIG. 16 shows a product holder mounted to two shelves as subject of the present invention.

FIG. 17, FIG. 18, FIG. 19, FIG. 20 and FIG. 21 show details of the product holder mounted to the shelves as subject of embodiments of the present invention.

Figure 1:
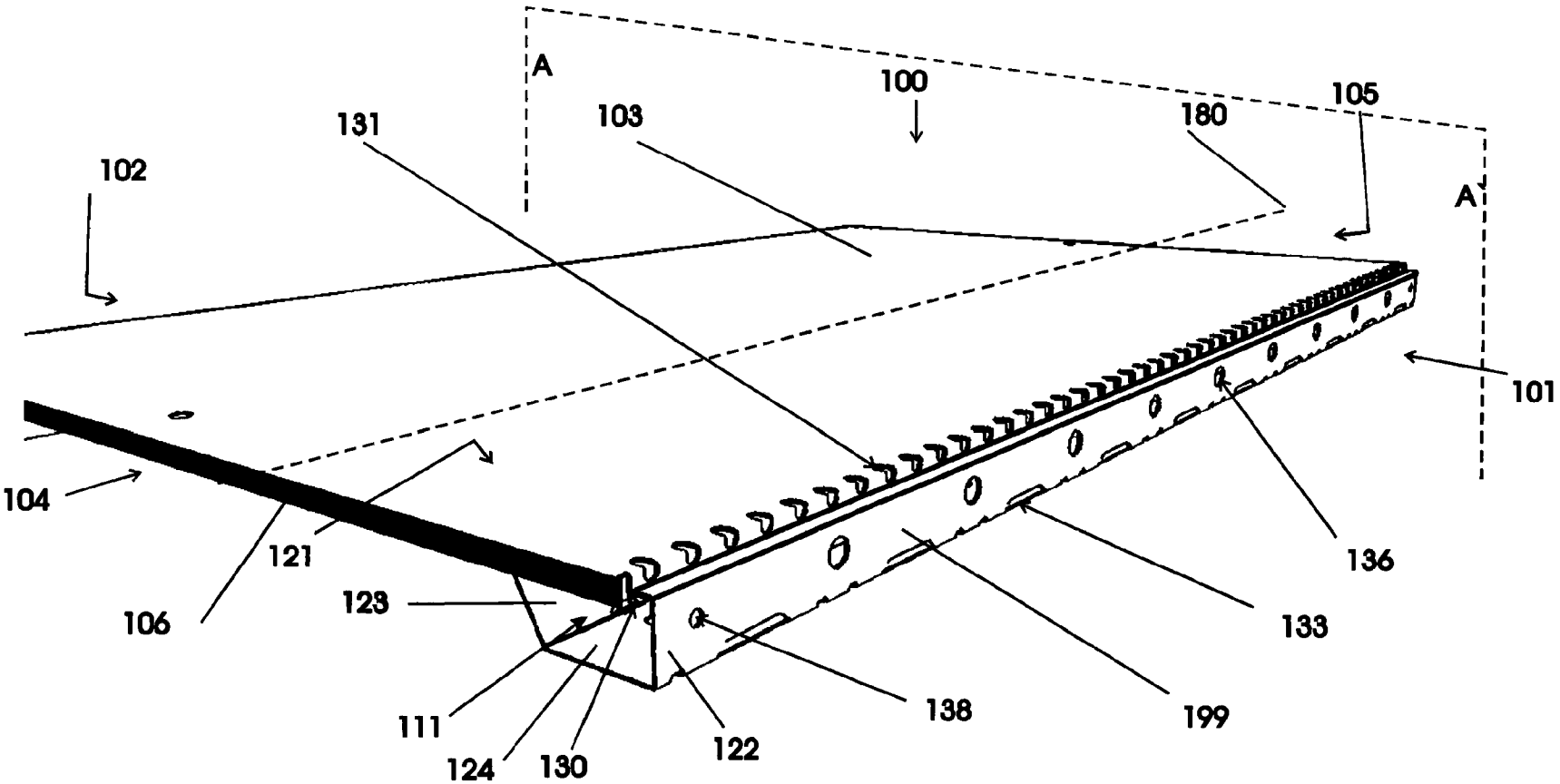
FIG. 1 schematically shows in perspective view a shelf as subject of embodiments of the present invention.
Figure 7:
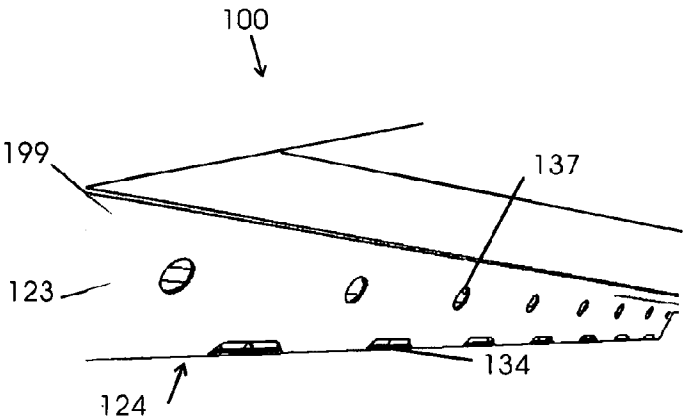

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "coupled", also used in the claims, should not be interpreted as being restricted to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The following terms are provided solely to aid in the understanding of the invention. These definitions should not be construed to have a scope less than understood by a person of ordinary skill in the art.

The term "channel" is to be understood as a hollow passage, usually tubular. For the purpose of the present invention, the channel preferably has a cross-section being preferably polygonal, such as triangular or quadrangular.

The term "enclosed" is to be understood to mean forming an internal void space, e.g. of a channel which is surrounded at least along its length by a wall. The two outer ends of the channel may be open. Thus the term "enclosed" when referring to a channel includes a tubular or cylindrical channel whereby the term cylindrical includes any suitable cross-section such as a regular or irregular polygon, e.g. a square, a parallelepiped, a trapezium, or similar. Where the void space is enclosed, the space cannot be reached by the fingertip of a person except by penetration through the enclosing wall.

The term "shelving unit" is to be understood as a unit for exhibiting products for display on at least one but optionally more than one shelf, which unit comprises at least one shelf and a means to hold the shelf in a position relative to the floor on which the unit is placed.

The term "longitudinal direction of the shelf" is understood as the direction parallel to the shelf front edge.

The term "substantially parallel planes" is to be understood as two planes having a dihedral angle between them, which angle is in a range of 0 to 10°.

The term "display elements" is to be understood as any object that is used to provide information on products displayed on the shelve unit, such as POS material, i.e. objects like a wobbler, a label, a product holder, a side banner, a flag, a sign, an electronic price tag, a shelf divider, a shelf extender and similar objects material, or illumination or displays, such as LCD displays, for providing product information, electronic balances or other electronic devices. All these display elements or any combination of such display elements form the display system. The terms "display elements", "point-of-sale elements" and "point-of-purchase advertising elements" are used throughout the description and may mean the same things, namely objects which may be attached to the front edge of a shelf, in particular for attracting attention to or giving information about items stored on the shelf, although not limited thereto.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

Figure 8:
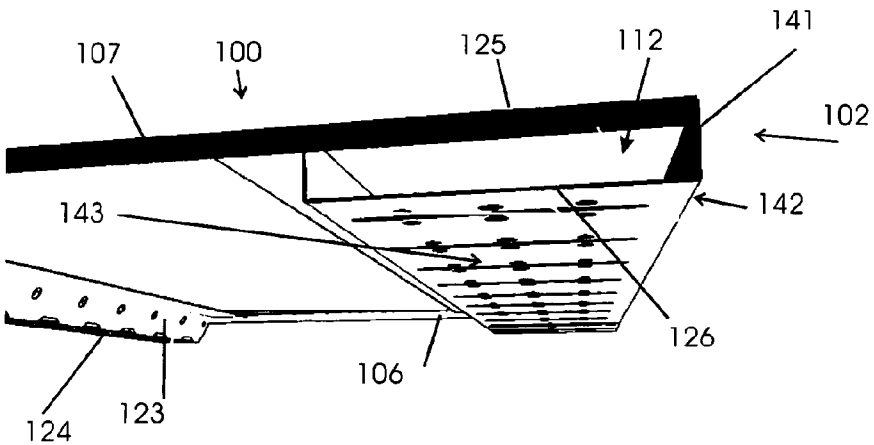
FIG. 8 shows a detailed view of the second enclosed channel at the back edge of the shelf of FIG. 1.

An advertising display shelf 100 as subject of the present invention is shown in perspective view in FIG. 1. The advertising display shelf is for carrying items or products on the shelf and for displaying advertising material on the front edge. FIG. 2 shows a top view of the shelf 100. FIG. 3*a* is a schematic side view of the back edge 102 of the shelf 100, whereas FIG. 3*b* is a schematic side view of the front edge 101 of the shelf 100. FIG. 4, FIG. 5, FIG. 6 and FIG. 7 show detailed views of the first enclosed channel 111 at the front edge 101 of shelf 100. The first enclosed channel preferably extends over a majority of the front edge of the shelf, e.g. at least 70% or at least 80% or at least 90% or completely over the front edge of the shelf. FIG. 8 shows a detailed view of the second enclosed channel 112 at the back edge 102 of the shelf 100. The shelf 100 is meant to be used in a shelving unit, which may comprise more than one, e.g. 2 3, 4 or 5 shelves 100 which are mount in a means to hold the shelf, e.g. a rack for providing support to the shelves, i.e. hold the shelves in a position relative to the floor on which the unit is placed and relative to each other. The shelves may be located vertically one above the other and several shelf units may integrated together, e.g. a series of uprights with shelves located therebetween to form a bank of shelves as is known in the trade.

The shelf 100 is made of sheet material. The sheet material may be electrically conductive. This sheet material may be a metal plate, e.g. normal steel or aluminium, which is formed into the shape as shown in the accompanying figures, e.g. by cold or hot rolling or by any other suitable means. The shelf may as well be provided by extrusion of e.g. aluminium, or by extrusion of any suitable polymer material, preferably fiber reinforced polymer material, e.g. reinforced by glass fibers, the fibers being either short fibers, e.g. shopped fibers, of endless long fibers of textile products provided from reinforcing fibers or yarns comprising reinforcing fibers. In case the sheet material is electrically conductive material, e.g. metal, or in case a sufficient amount of electrically conductive material is added to otherwise electrically non-conductive material, e.g. polymer sheet material, or in case the inner surface of the channel is covered with electrically conductive material, e.g. a conductive tape or coating, the inner void of the first channel 111, and optionally the inner void of the second channel 112 is electrostatically shielded or screened.

The shelf 100 has a front edge 101 and a back edge 102 and a load carrying flat portion 103 for carrying the products to be carried by the shelf and the shelf unit. The front edge 101 comprising a support 199. The sheet material at the front edge 101 is formed as a first enclosed channel 111 which the channel provides the support 199 at the front edge 101 of the shelf 100. The first enclosed channel preferably extends over a majority of the front edge of the shelf, e.g. at least 70% or at least 80% or at least 90% or completely over the front edge of the shelf.

The first enclosed channel 111 at the front edge 101 of the shelf 100 has a cross-section according to a plane AA' substantially perpendicular to the longitudinal direction 180 of the shelf 100. This cross-section is preferably substantially polygonal, either irregular or regular. This is best visible in FIG. 3*b*. The polygon shown in FIG. 3*b* is a substantially quadrangular, substantially convex polygon. It is understood that also other polygons, preferably convex polygons may be used.

As best shown by means of the polygonal cross-section, the first channel 111 has a first side 121 being part of the load carrying flat portion 103, a second side 122 providing the front side of the support and a third side 123 facing towards the back edge 102 of the shelf 100. The fourth side 124 is substantially parallel with the first side 121. The front edge 101 being the first enclosed channel 111 forms one integral part with the load carrying flat portion 103.

Along the front side 101 of the shelf 100, the sheet material is provided with at least one ridge 130. This ridge will, as shown in FIG. 10, FIG. 11, FIG. 12*a* and FIG. 12*b*, be used to provide a snap fit to a datastrip 201 along the front side 101 of shelf, i.e. along the support 199.

This ridge 130 is also present in the cross-section according to plane AA' (FIG. 3*b*) as a fold in the second side 122 of the shelf 100.

The support 199 preferably has several different apertures for allowing mounting of suitable information displays. The apertures may be provided in a regular or irregular pattern. The apertures may all have the same shape, or may have different shapes. For example, wobblers, labels, product holders, side banners, flags, signs, electronic price tags, shelf dividers, shelf extenders, shelf talker, aisle dividers, touch screen displays, and the like can be mounted to the shelf 100 at the front side 101 of the shelf 100.

At the ridge along the longitudinal direction of the shelf at the coupling of the first and second side of the pentagonal cross-section, the shelf is provided with apertures 131 which extend along the load carrying flat portion 103 and inside the ridge 130. In the fourth side 124 of the channel, beyond the apertures 131, according to a projection substantially parallel with the second side 122 and perpendicular to the side 121, apertures are provided, as can be seen a.o. in FIG. 5. These apertures may be of identical shape as apertures 131, or may be made as longitudinal slits 132. These apertures 131 and 132 will be of use to mount point-of-purchase advertising elements such as e.g. flags, product holders, wobblers, labels, electronic price tags, side banners, aisle dividers as will be explained by means of FIG. 13 to FIG. 23.

Along the longitudinal direction of the shelf at the back edge, similar apertures 141 may be provided in the load carrying flat portion 103. The back edge 102 of the shelf can also be formed as a second enclosed channel 112, e.g. in the form of a regular or irregular polygon. In this particular embodiment a rectangular shaped channel is shown. One long side 125 of the rectangle is part of the load carrying flat portion 103. In the second long side 126 of the rectangular shape of this second channel 112, beyond the apertures 141, according to a projection substantially parallel with the second side 122 and perpendicular to the side 121, apertures 142 are provided. These apertures 141 and 142, together with apertures 131 and 132 at the front edge 101 of the shelf 100, may be of use to mount POS material such as shelf dividers as will be explained by means of FIG. 24 to FIG. 25. These apertures 141 and 142, together with apertures 131 and 132 at the front edge 101 of the shelf 100 may be used to carry heavy materials. An even weight distribution provides improved safety to consumers For too heavy POS material, when using front fixation alone, the shelf could tilt towards consumers as products are moved or taken away so the original weight distribution changes which perturbs the weight equilibrium.

Figure 9:
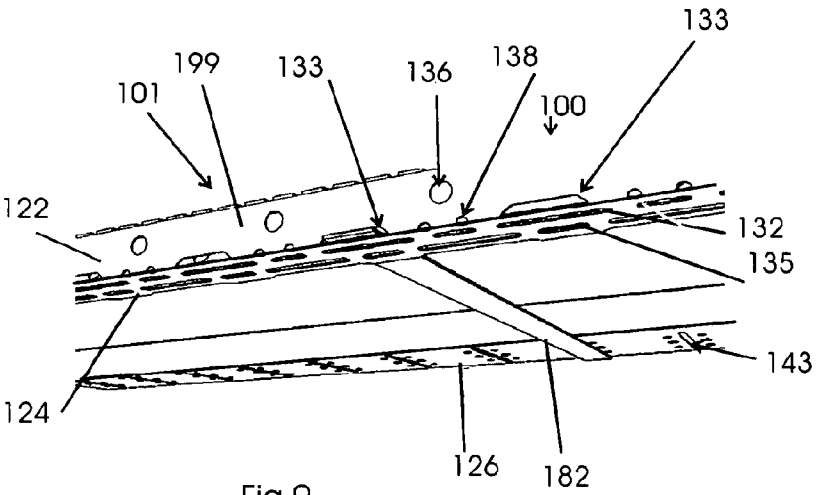
FIG. 9 shows a reinforcing strip fixed between the front edge and the back edge of the shelf of FIG. 1.
Figure 6:
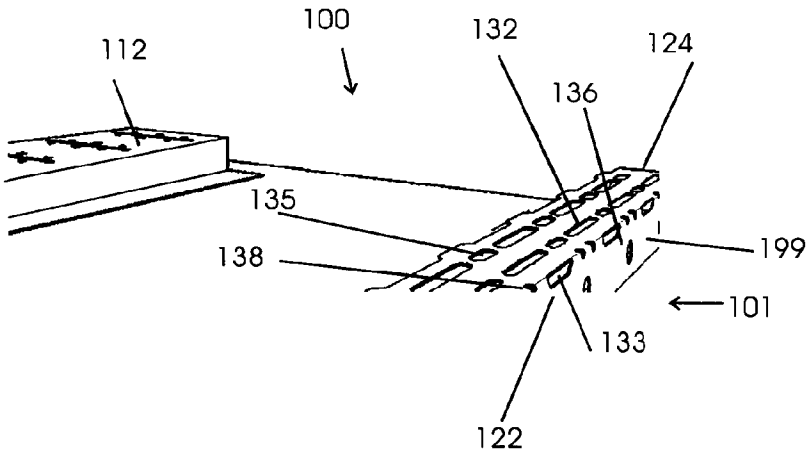

At the coupling of the second side 122 and fourth side 124, a number of substantially identical lateral slits 133, substantially equally spaced in longitudinal direction 180. Along the coupling of third side 123 and fourth side 124, at the height of the slits 133, identical slits 134 are provided. These slits 133 and 134 will be used to fix reinforcing bars or reinforcing strips 182 between the front edge 101 and the back edge 102. These bars and/or strips 182 may be used to provide more mechanical stability to the shelf 100 and the shelving unit, or may be used to distribute the weight of more heavy POS material mounted to the front edge 101 of the shelf 100, over a larger surface of the shelf, i.e. distribute the weight over both the front edge 101 and the back edge 102. As shown in FIG. 9, the strips 182 are extending through the slits 134 and 133 towards the back edge of the shelf 100. At the back edge, the strips are coupled to the lower side 126 of the second channel 112, in which appropriate apertures 143 are provided to make the coupling by e.g. bolts and nuts or well nuts or similar means. At the front edge, the strips 182 may be coupled to the first channel 111 by means of bolts and nuts, well buts or similar means, making use of the apertures 132, or by means of additional apertures or slits 135.

Along the second side 122 of the first channel 111, a number of apertures form mounting means or fixation points. For example, substantially circular openings 136 may be provided, substantially equally spaced in longitudinal direction 180, which may be used to have sockets extending through one of the plurality of apertures for coupling electronic devices to the at least one electrical conductor at the exterior of the first enclosed channel, as will be explained by means of FIG. 33 to FIG. 39. Similarly, along the third side 123 of the first channel 111, a number of apertures, e.g. substantially circular openings 137, may be provided, optionally substantially equally spaced in longitudinal direction 180, which may be used to have sockets extending through at least one of the plurality of apertures for coupling electronic devices to the at least one electrical conductor at the exterior of the first enclosed channel. These mounting means or fixation points or openings 136 and 137 may also be used as guiding means for mounting pins of objects to be mounted to the support 199, or as openings for receiving bolts, feedthroughs, or similar means.

Optionally additional openings 138 or lateral slits 139, optionally also forming mounting means or fixation points, may be provided in the second side 122 of the first channel 111. Alternatively, the additional openings 138 or lateral slits 139 may be used as openings for guiding giving access to material like e.g. a screw driver.

Additionally the openings may be formed with tabs, i.e. the opening is formed by bending a portion of the sheet material of the shelf outwards or inwards or may be formed as a boss, e.g. by stamping or drawing lips in the sheet material.

At the two outer ends 104 and 105 of the shelf, lips 106 and 107 are provided to establish a coupling to the shelf supporting means of the shelving unit, e.g. the rack.

Figure 10:
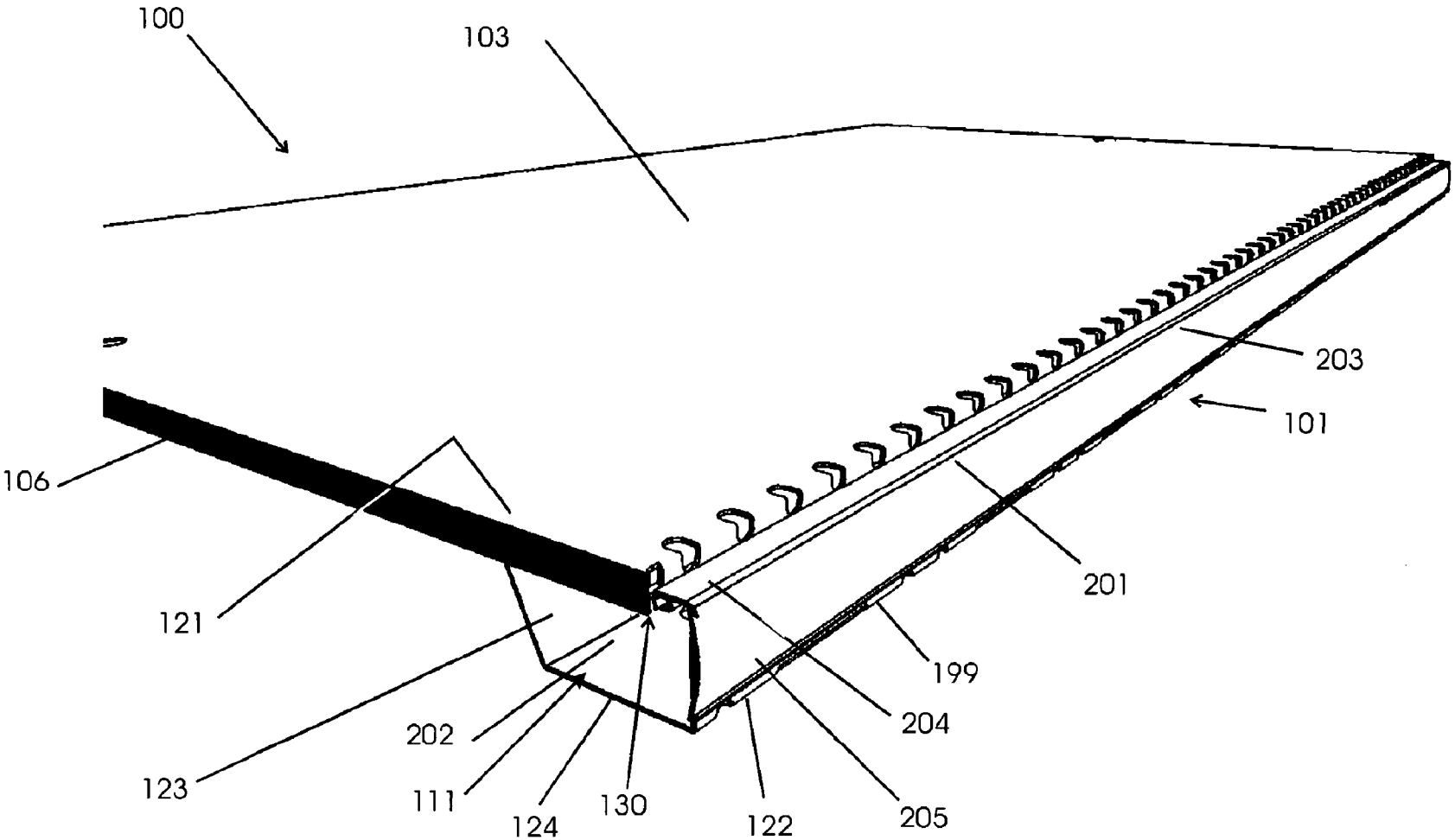
FIG. 10, FIG. 11 show in perspective view a data strip mounted to the support of the shelf of FIG. 1.
Figure 12:
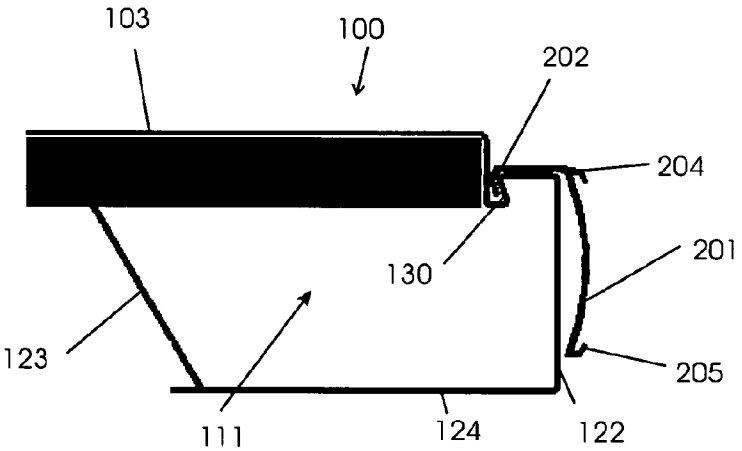
FIG. 12 shows in side view the data strip mounted to the support of the shelf of FIG. 1.
Figure 11:
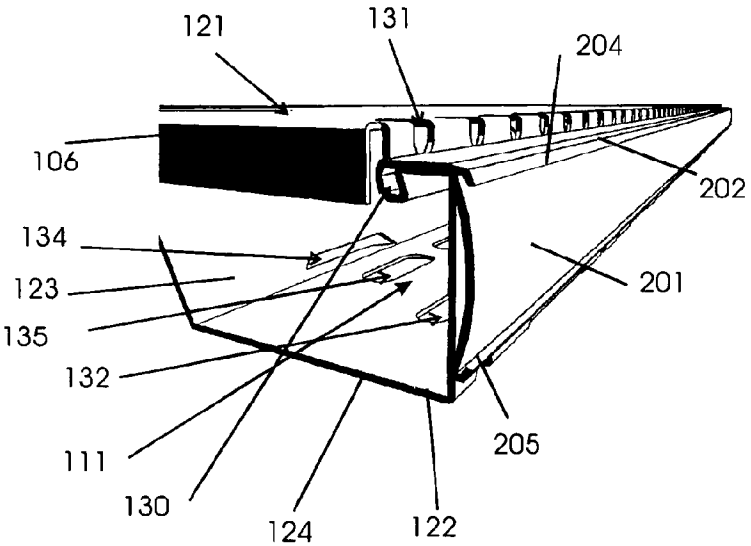

As shown in FIG. 10, FIG. 11, and FIG. 12, a data strip 201 can be mounted along the front edge 101 of the shelf 100. The data strip 201 has a hook-like profile and has at one side a means 202 for snap fitting in the ridge 130. The data strip 201 may have one face side 203 which is to be mounted in front of the side 122 of the channel 111. On this data strip 201, means like runners 204 and 205, between which informative cards can be inserted.

As shown in FIG. 13 to FIG. 23, the ridge and the apertures 131 and 132 may be of use to mount point-of-purchase advertising objects such as flags, product holders, wobblers, labels, electronic price tags, side banners, aisle dividers and the like to the shelf 100.

Figure 13:
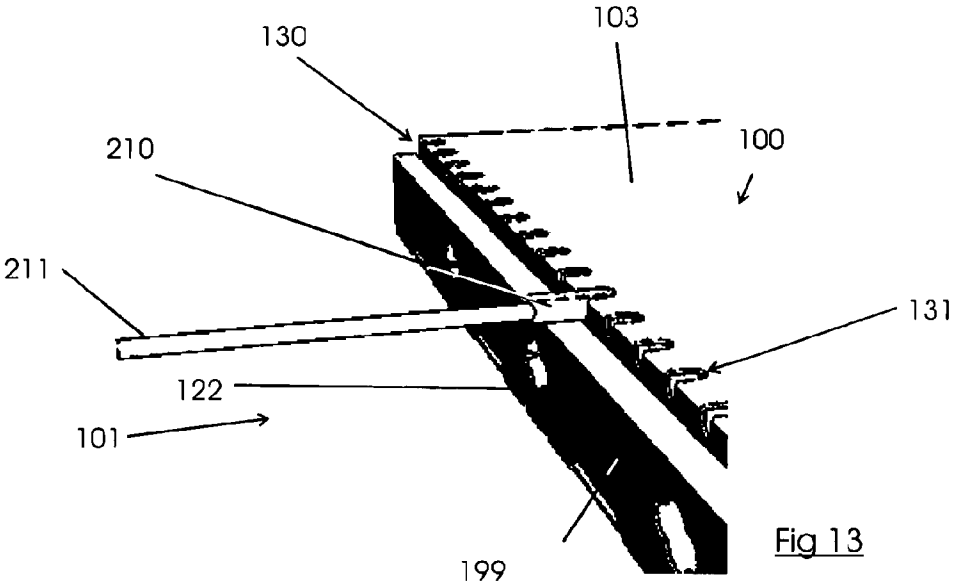
FIG. 13 shows in perspective view a horizontally extending object mounted to the support at the ridge of the shelf of FIG. 1.

As shown in FIG. 13 to FIG. 15, a substantially horizontally extending object, e.g. a pole 211 for carrying a flag, can be mounted to the support 199 of shelf 100 by means of a clips 210. The clips 210 can be inserted in one of the apertures 131 at the front side 101 of the shelf 100. The clips has a body 212 for receiving one end of the pole and for extending the pole in a direction substantially in the plane of the load carrying flat portion 103. The clips 210 is inserted in the aperture 131 by means of a first hook-shaped lip 213, having a hook 214 which clicks over the lower side of the ridge 130 at the inner side of the channel 111. It is understood that the ridge and the hook 214 are provided with cooperating shapes. A second lip 215 is positioned to extend into the recess of the ridge when the clip is mounted. The clip further has a closing means 216 for closing the aperture 313 along the first side 121. It is understood that similar, preferably lightweight objects can be coupled to the shelf by means of these or similar clips. Such alternative objects are e.g. POS such as wobblers and the like.

The clips 210 may be provided out of metal or polymer, depending on e.g. the required mechanical strength of the clips.

Figure 18:
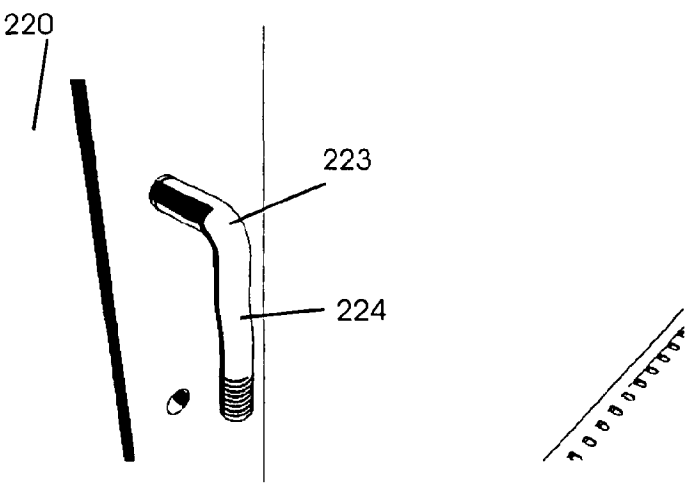
Figure 20:
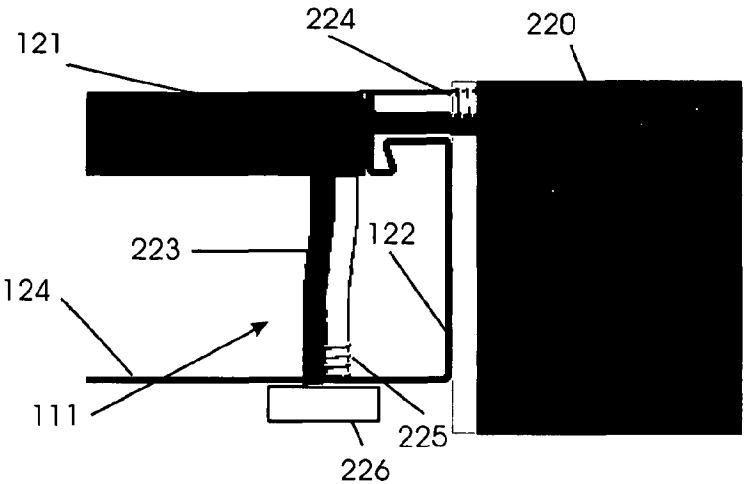
Figure 17:
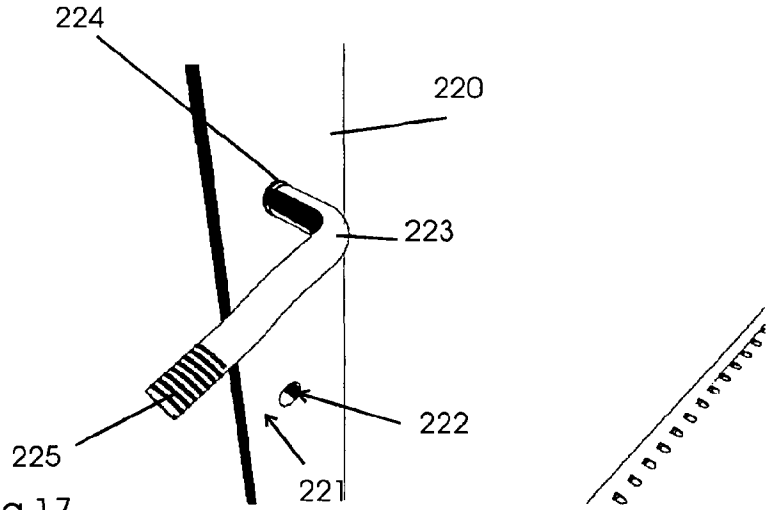
Figure 19:
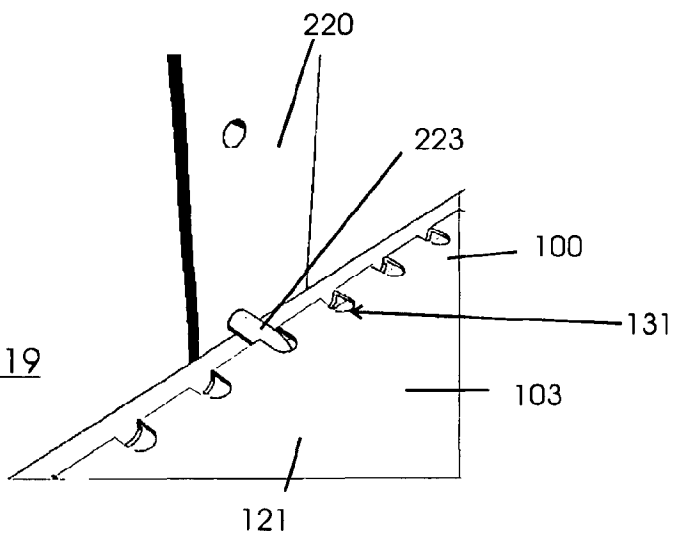

As shown in FIG. 16 to FIG. 22, also more heavy objects can be mounted to the support 199 and the shelf 100. FIG. 16 shows a product holder 220, which is mounted to a first shelf 100 and a second shelf 200. As shown in FIG. 17, the product holder is provided at its backside 221 with holes 222, which holes are screw threaded at its inner side. In at least one of these holes, a connection device such as an angled bar 223 is screwed. The angled bar has at a first end 224 a screw thread which engages the screw thread provided in the holes 222. The angled bar 223 is screwed to such an extent that it is fixed to the backside 221 of the product holder, and that the second end 225 faces downwards, as shown in FIG. 18. as shown in FIG. 19 and FIG. 20, the angled bar 223 is inserted in one of the apertures 131 of the shelf 100, and the lower end 225 extends through an aperture 132 at the fourth side 124 of the channel 111. The angled bar 233 and as such the product holder 220 is fixed to the first enclosed channel 111, and as such to the shelf 100 by screwing a bolt 226 on the screw threaded second end 225 of the angled bar 223. The angled bar is clamp to the fourth surface 124 of the channel 111.

As shown in FIG. 21, such fixation can be provided at a plurality of levels, e.g. at two shelves 100 and 200 in a similar way.

Figure 22:
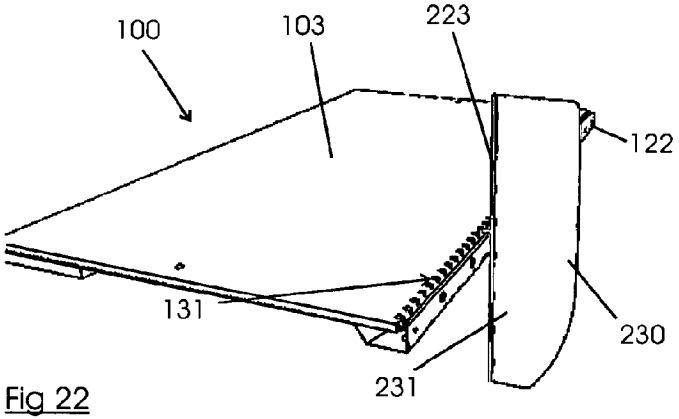
FIG. 22 shows an aisle divider mounted to a shelf as subject of embodiments of the present invention.
Figure 23:
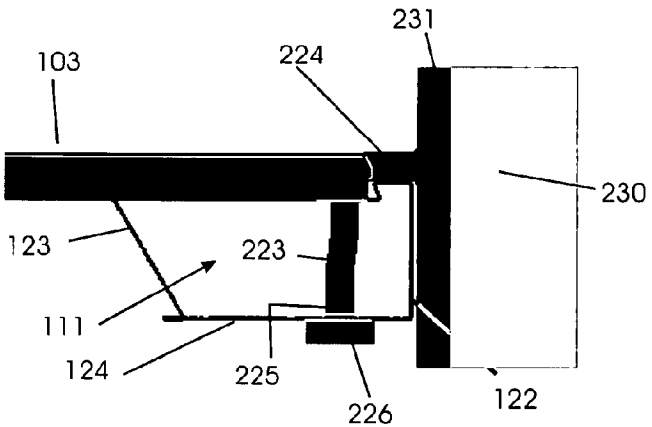
FIG. 23 shows a detail of the aisle divider of FIG. 22.

In a similar way, an aisle divider 230 can be mounted to the support 199, as shown in FIG. 22 and FIG. 23. However, in this particular embodiment, the first end 224 of the angled bar 223 is coupled to a supporting bar 231 of the aisle divider 230.

Figure 24:
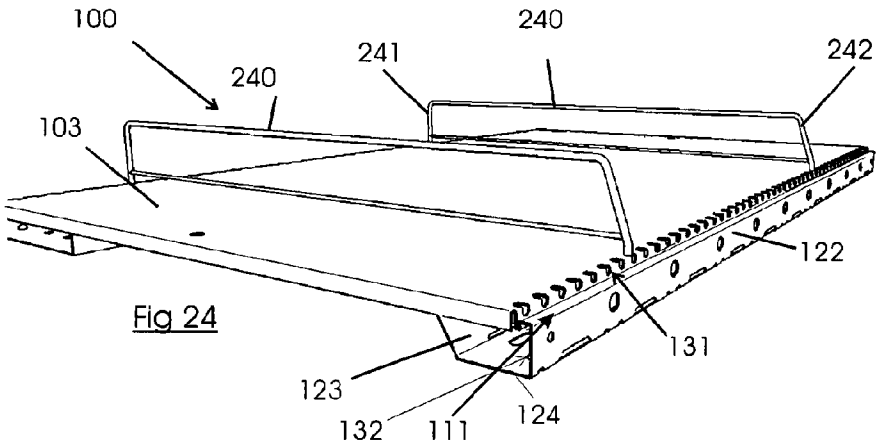
FIG. 24 shows in perspective view a shelf divider fixed to the shelf of FIG. 1.
Figure 25:
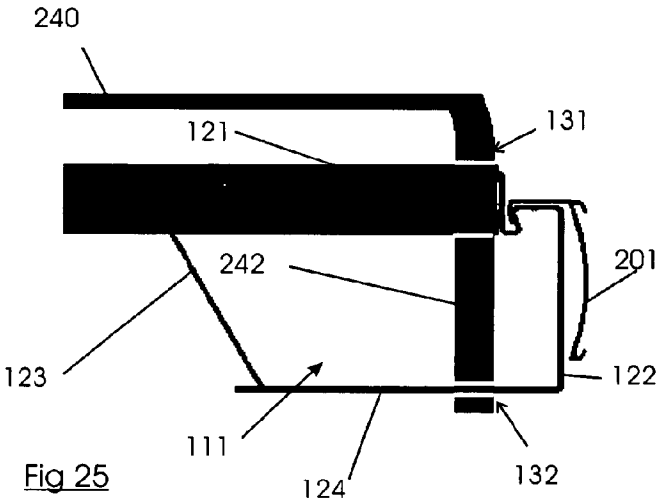
FIG. 25 shows a side view of the shelf divider fixed to the shelf of FIG. 24.

As shown in FIGS. 24 and 25, the apertures 141 and 142 at the back edge 102 of the shelf 100, together with apertures 131 and 132 at the front edge 101 of the shelf 100, may be of use to mount shelf dividers 240. The shelf dividers may have two downwards extending legs 241 and 242. As shown in FIG. 24, at the front edge 101, the first leg 241 is inserted through an aperture 131 along the ridge 130 and through the corresponding aperture in the fourth side 124. Similarly the second leg 242 is inserted at the back edge 102 through an aperture 141 and a corresponding aperture 142. During use, the products displayed on the shelf 100 may cause the shelf divider to rotate sidewise about the point of insertion in the load carrying flat portion, i.e. points coinciding with apertures 131 and 141. As the legs 241 and 242 extend through the fourth surface 124 of the first channel 111, or through the side of the second channel 112 parallel to the load carrying flat portion 103 a stabilisation of the shelf dividers may be obtained. This is because the legs 241 and 242 at the lower side of the first and second channel prevent further rotation when the legs contact the border of the apertures 132 and/or 142. Similarly as shown in FIG. 20, the downward extending legs 241 and/or 242 can be provided with screw thread. By means of a bolt, the legs 241 and/or 242 can be screwed to the lower side of the fourth surface 124.

Figure 26:
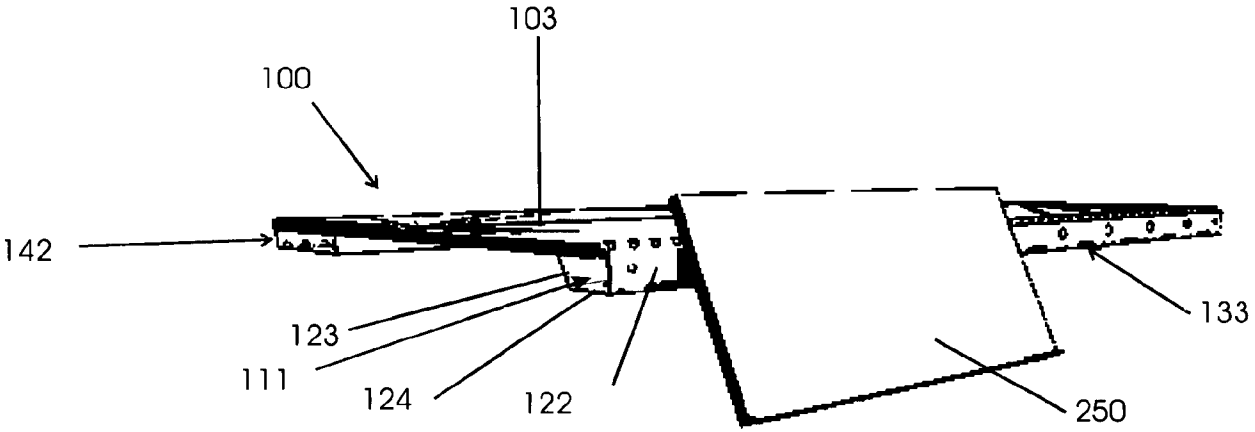
FIG. 26 shows in perspective view a shelf talker mounted to the shelf of FIG. 1.
Figure 28:
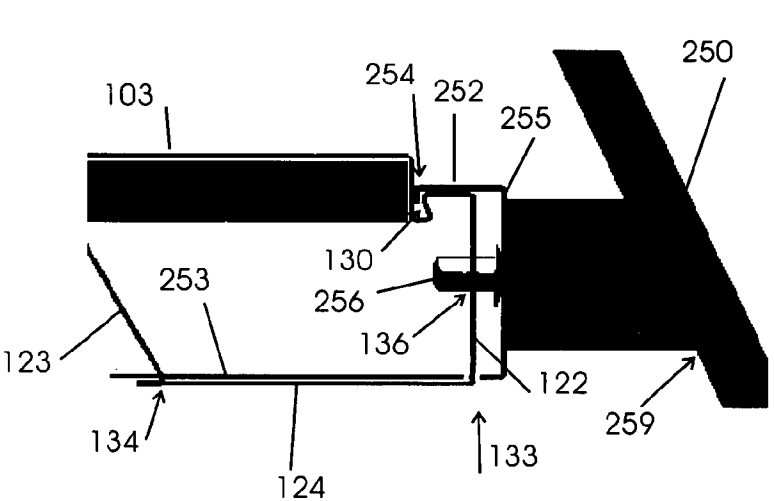
FIG. 27 and FIG. 28 show details of the shelf talker of FIG. 26.
Figure 27:
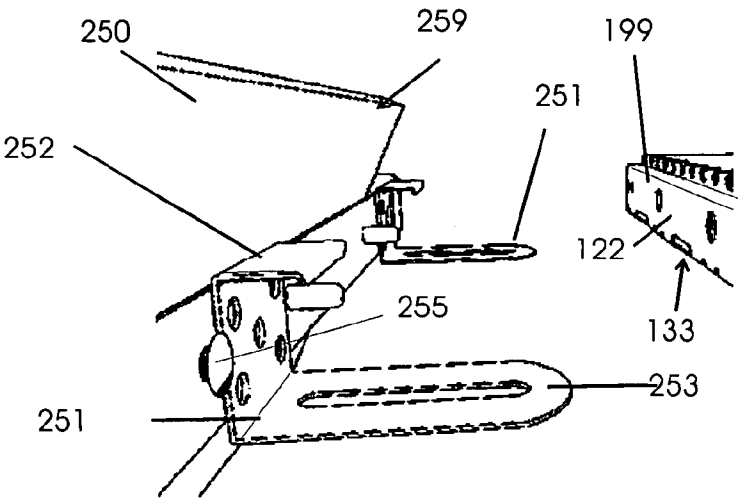

FIG. 26 to FIG. 28 show haw the slit-like apertures 133 and 134 in the second and fourth side of the first channel 111 can be used to mount POS objects such as shelf talker 250, to the support 199 and the shelf 100. In FIG. 27 and FIG. 28, it is shown that a number of U-shaped profiles 251, in this particular embodiment two U shaped profiles 251, are provided to the backside 259 of the shelf talker 250. Each U shaped profile 251 comprises two legs 252 and 253. The first leg 252, being the upper leg of the U profile when mounted to the backside 259, is provided with a hook 254, which clicks or snap fits in the ridge 130 when the shelf talker 250 is mounted to the support 199. The lower leg 253 is inserted through the slit 133 at the lower side of the second side 122 near the coupling with fourth side 124, and extends through the slit 134 at the coupling of the third side 123 and the fourth side 124. The insertion of leg 253 through the slit 134, and the snap fitting of leg 252 in ridge 130 prevent the shelf talker to rotate downwards. The shelf talker can be mounted to the first channel 111 by means of fixing means inserted through corresponding holes in the fourth side and the leg 253, and or by fixing the intermediate part 255, coupling the first leg 252 and second leg 253 of the U profile, to the second side 122 of the channel 111, making use of the mounting means or fixation points or apertures 136 or similar apertures provided. As shown in FIG. 28, a well nut 256 is provided between intermediate part 255 and second side 122 an aperture 136. The U-shaped profiles may be mounted to the backside 259 by means of screws.

Similar objects as shelf talkers, e.g. LCD screens or shelf extenders can be mounted to the support 199 of shelf 100.

Figure 30:
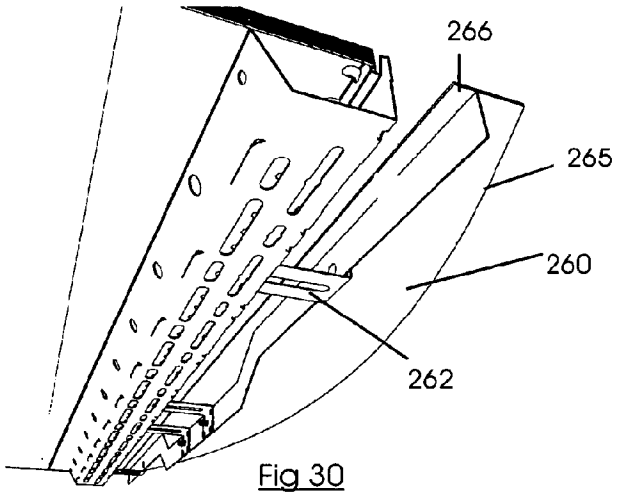
FIG. 29, FIG. 30 and FIG. 31 show details of a shelf extender fixed to a shelf as shown in FIG. 1.
Figure 29:
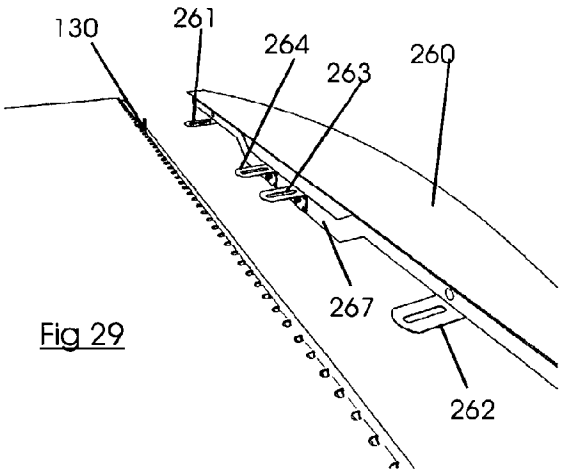
Figure 31:
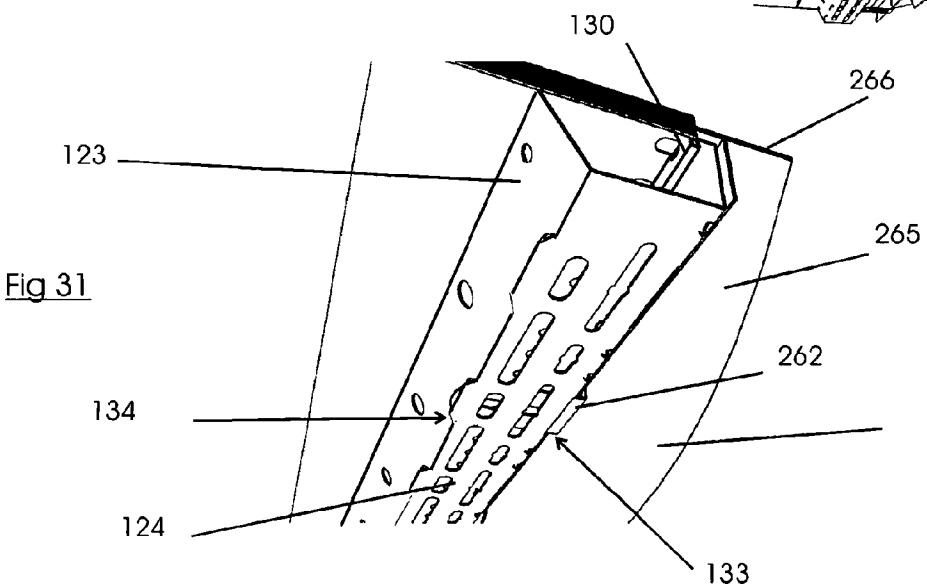

As shown in FIG. 29, FIG. 30 and FIG. 31, a shelf extender 260 is coupled to the first channel 111, and thus the support 199, by means of four shaped profiles 261, 262, 263 and 264, which are slideably mounted in the slits 133 and 134 in a similar way as explained in FIGS. 26 to 28. The shelf extender 260 has a extending surface 265 which has a zone 266 extending over the ridge 130. The shelf extender has a curved bar 267. The profiles are provided in such a way that the leg which is to slide in the slits 133 and 134 are located at the height of the slits. By correctly choosing the dimension of the curve of bar 267, identical profiles can be used for the profiles 261, 262, 263 and 264.

Figure 34:
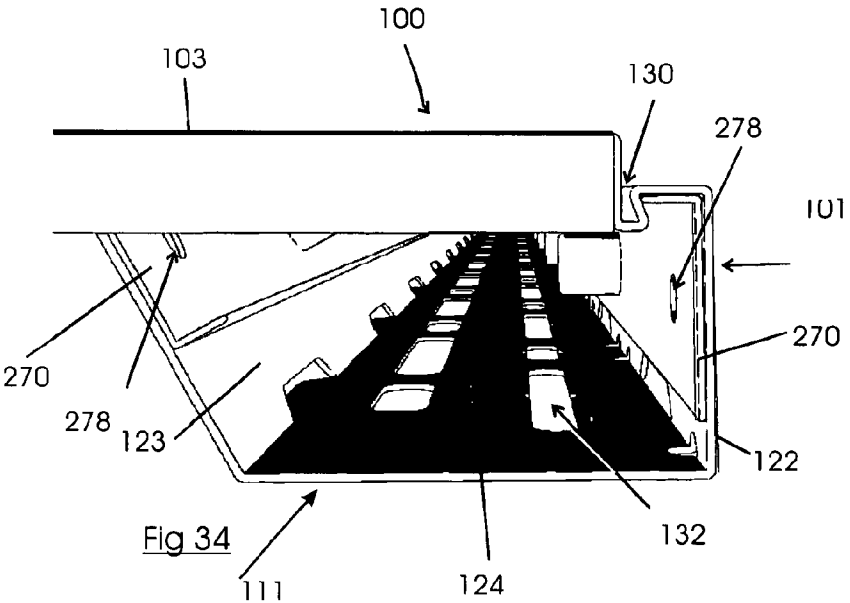
FIG. 33, FIG. 34 and FIG. 35 show details of two conductor strips being mounted in the first channel of the shelf of FIG. 1.
Figure 35:
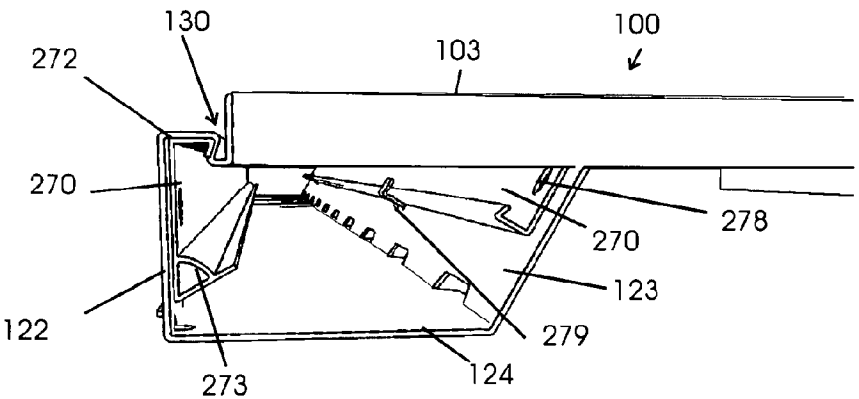
Figure 32:
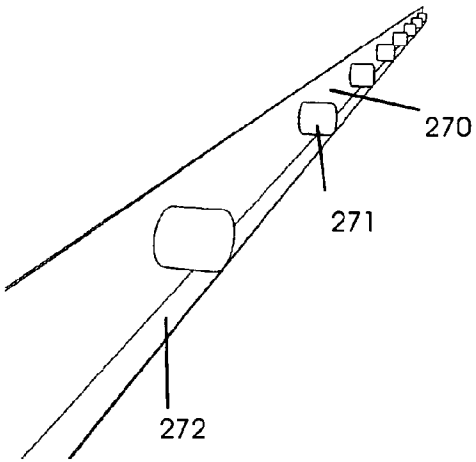
FIG. 32 shows a conductor strip, which may be used in the shelf as subject of embodiments of the present invention.
Figure 33:
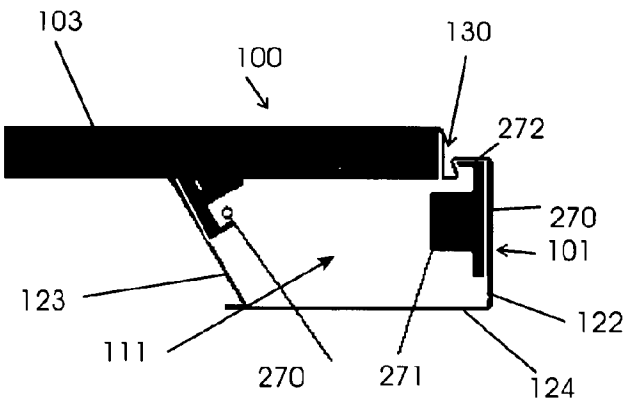
Figure 37:
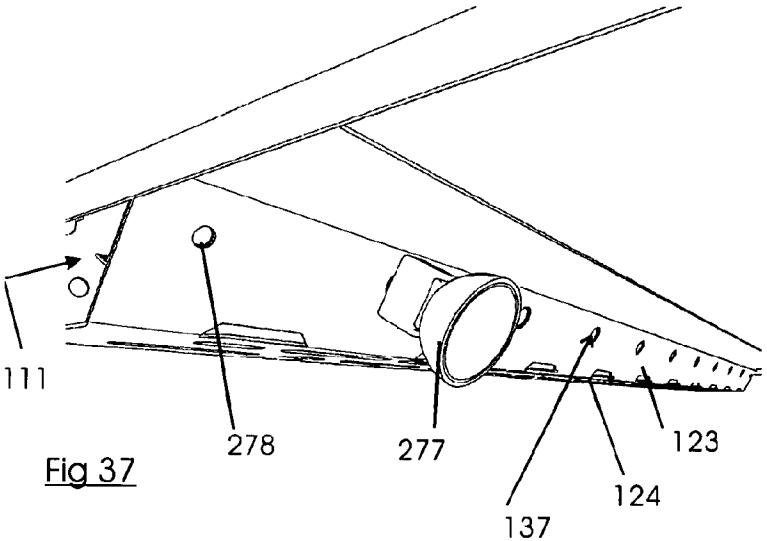
FIG. 37 shows a halogen lamp being coupled to a shelf comprising conductor strips as shown in FIG. 32 to FIG. 35.

As shown in FIG. 32, FIG. 33, FIG. 34 and FIG. 35, a conductor strip 270 is provided comprising at least one electrical conductor embedded in an electrically insulating material. The conductor strip, being a plastic bar with build in electric wiring, comprises a number of sockets 271 for plugging in electronic devices to the at least one electrical conductor at the exterior of the first enclosed channel is provided in the first enclosed channel as shown in FIG. 33, FIG. 34 and FIG. 35.

The conductor strip comprising sockets, each positioned in line with one of the plurality of mounting means or fixation points, apertures 136, in the second side 122 of the first channel or in line with one of the plurality of apertures 137 in the third side 123 of the first channel. The dimensions of the strip and the socket are chosen such that the socket does not disturb passage of objects through the apertures 131 and 132, nor though slits 133 and 134. The strips 270 may comprise a lip 272 which caused the strip to click at the ridge 130 at the inner side of the first channel 111. The shape of the ridge 130 and the shape of the lip 272 are made in such a way that a clicking engagement is made possible. Optionally the strip 270 is provided with a second lip 273 for reinforcing the strip profile and increase the bending resistance. The strip profile is made in such a way that the conductor strip makes contact with the inner surface of the at least one of the second and third side of the first enclosed channel. The inner surface of the at least one of the second and third side, e.g. the third side 123 may be provided with additional lips 279 for providing additional support to the strip 270 and for improving the contact between strip 270 and inner surface of the third side 123. The strip may be fixed to the sides of the channel 111 by means of screws, screwed into the strip 270 through apertures 138. Facing the apertures 138, the strip may be provided with blind holes or apertures 278 having an inner wall with engaging screw thread.

Figure 36:
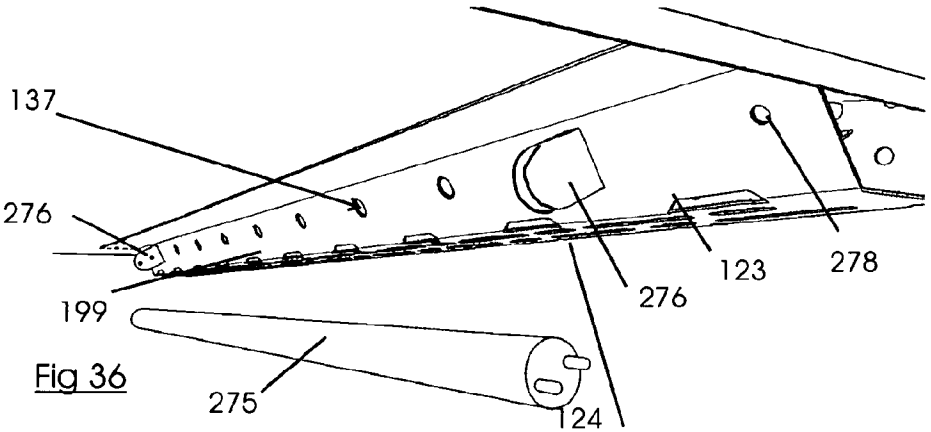
FIG. 36 shows a TL lamp being coupled to a shelf comprising conductor strips as shown in FIG. 32 to FIG. 35.

As shown in FIG. 36, the conductor strips comprising sockets 271 may allow TL lamps 275 to be mount along the third side 123 of the channel 111 at the outer side of the first channel 111. Two TL-coupling means 276 are plugged in two sockets 271 through two apertures 137 in the third side of the first channel 111. By providing a TL lamp between the two TL-coupling means 276, and by providing appropriate electrical power via the conductors in the strip 270 and via the sockets 271, illumination of the lower side of the shelf 111 can be obtained.

In a similar way, other illumination means can be coupled to the conductor strips 270 in the first channel 111. As an example shown in FIG. 37, halogen lamps 277 with appropriate plugs are plugged into a socket 271 accessible via an aperture 137.

Figure 39:
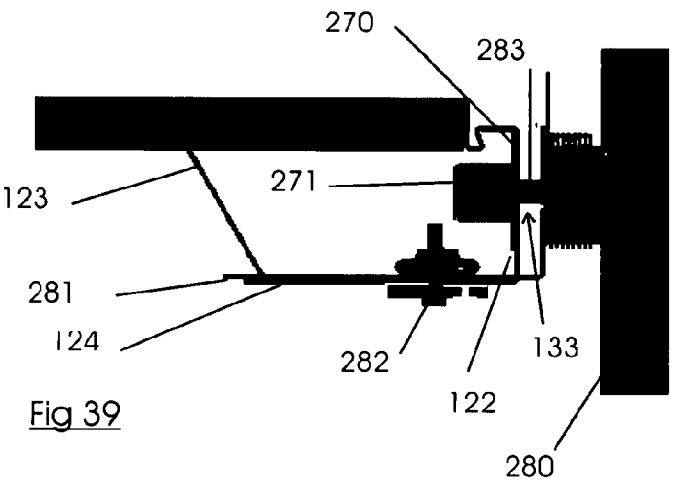
FIG. 39 shows a side view of the touch screen being coupled to a shelf comprising conductor strips as shown in FIG. 38.
Figure 38:
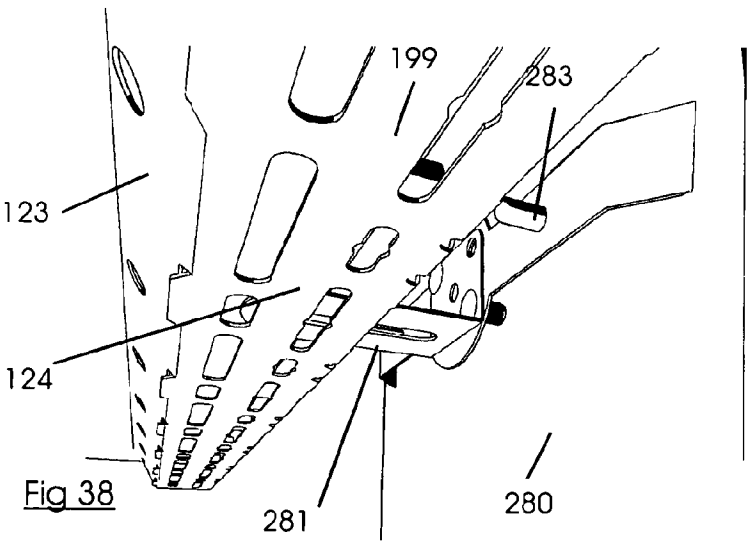
FIG. 38 shows a perspective view of a touch screen being coupled to a shelf comprising conductor strips as shown in FIG. 32 to FIG. 35.

As another example of an electronic device coupled to at least one electrical conductor at the exterior of the first enclosed channel, FIG. 38 and FIG. 39 show an active point-of-purchase advertising element, e.g. a touch screen display 280, for displaying product information, which is coupled to a conductor strip 270 which is provided along the second side 122 of the first channel 111. By means of an L profile 281, which is screwed to the back side of the touch screen display 280, the touch screen display 280 is fixed to the support 199 by sliding the lip of the profile through the slits 133 and 134, similarly as explained by means of FIG. 26 to FIG. 28. The L profile is fixed to the fourth side 124 by means of a well nut 282.

The touch screen display is provided with at least one, but optionally two or more electrical contacting plugs 283. When mounting the touch screen display to the support, the plugs 283 are to fit into appropriate sockets 271 of the strip 270, via apertures 133 in the second side 122 of the first channel 111. via the sockets 271, electrical power as well as data to be displayed can be provided to the touch screen display, as well as data which can be obtained from the touch screen display. Via electrical conductors in the strip 270, the touch screen display 280 can be coupled to a information processing unit, which unit can update the information on the display in real time. The touch screen display 280 may be an LCD display.

It is understood that also other active point-of-purchase advertising elements, such as ordinary displays, having no touch screen feature, can be mounted and fixed to the support 199 in a similar way, e.g. LCD screens.

It is understood that other displays can be coupled to the unit via similar coupling, and can be mounted and fixed to the support in similar way. It is also understood that other electronic devices such as electronic bascules can be coupled to a processing unit and be provided with appropriate electric power in a similar way. The second channel 112 can be used in a similar way to comprise electrical cabling or electronic devices.

It is understood that the conductor strips may be provided with a number of conductors for carrying data or electric power, being AC or DC, optionally on different voltage levels.

An alternative shelf 300 is shown in FIGS. 40 to 45. The same reference numbers refer to the same or similar features of the shelf 100, and have the same function.

Shelf 300 differs from shelf 100 in the shape of the mounting means or fixation points, illustrated in the drawings by means of openings 136 and 137. Along the second side 122, substantially circular openings 336 are provided, which openings 336 have two axially opposed slits 340. Similarly, along the third side 123 of the first channel 111, a number of substantially circular openings 337 are provided, which openings 337 have two axially opposed slits 340.

Apertures 337 and 336 may be provided, substantially equally spaced in longitudinal direction 180, which may be used to have sockets extending through one of the plurality of apertures for coupling electronic devices to the at least one electrical conductor at the exterior of the first enclosed channel.

Optionally, these openings 336 and 337 may also be used as guiding means for mounting pins of objects to be mounted to the support 199, or as openings for receiving bolts, feedthroughs, or similar means.

Figure 45:
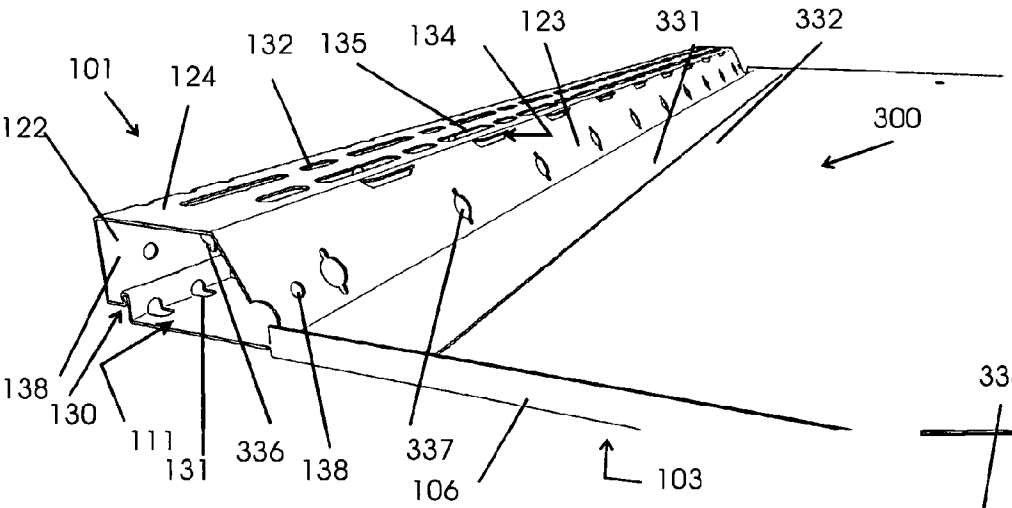
Figure 44:
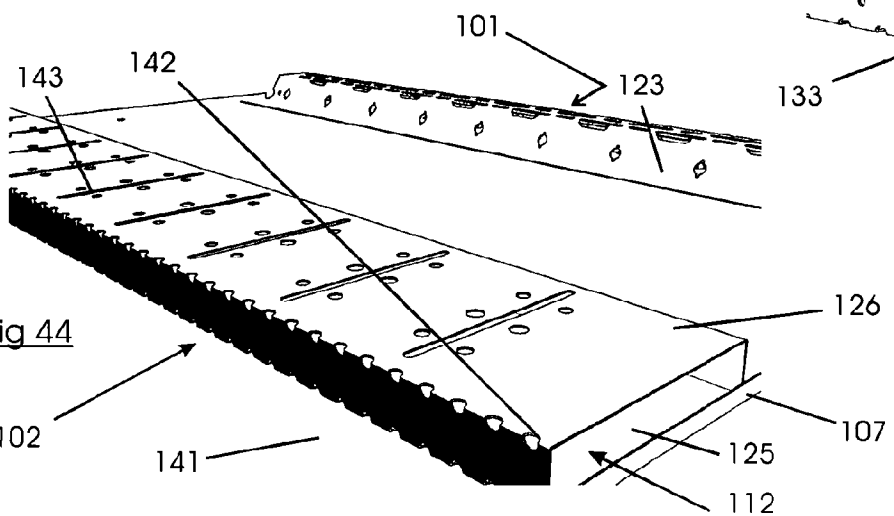

As best shown in FIG. 45, the sheet material is deformed in such a way that a the lower side 332 of the load carrying flat portion 103, the sheet material has a part 331 which is substantially parallel to this lower side 332, and which may be used to fix the sheet materials of this part 331 and the sheet material providing the load carrying flat portion 103.

Figure 40:
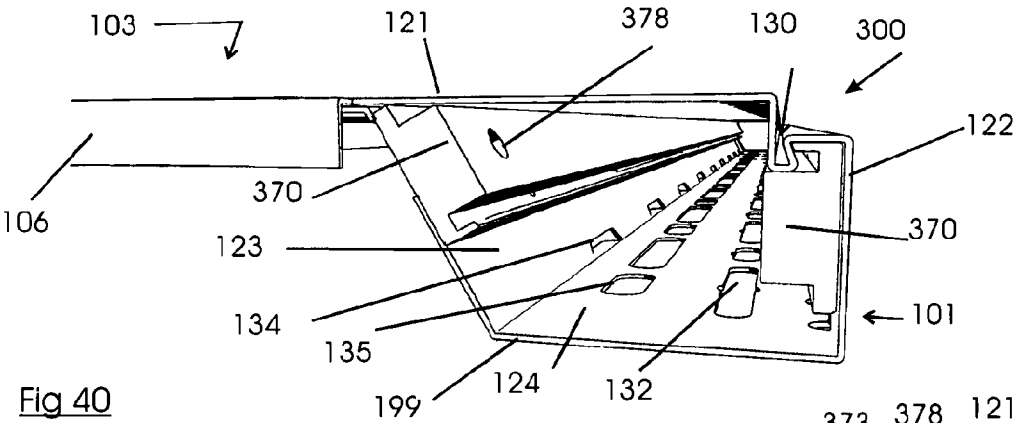
FIG. 40, FIG. 41, FIG. 42, FIG. 43, FIG. 44 and FIG. 45 show an alternative shelf as subject of embodiments of the present invention, comprising two conductor strips.
Figure 41:
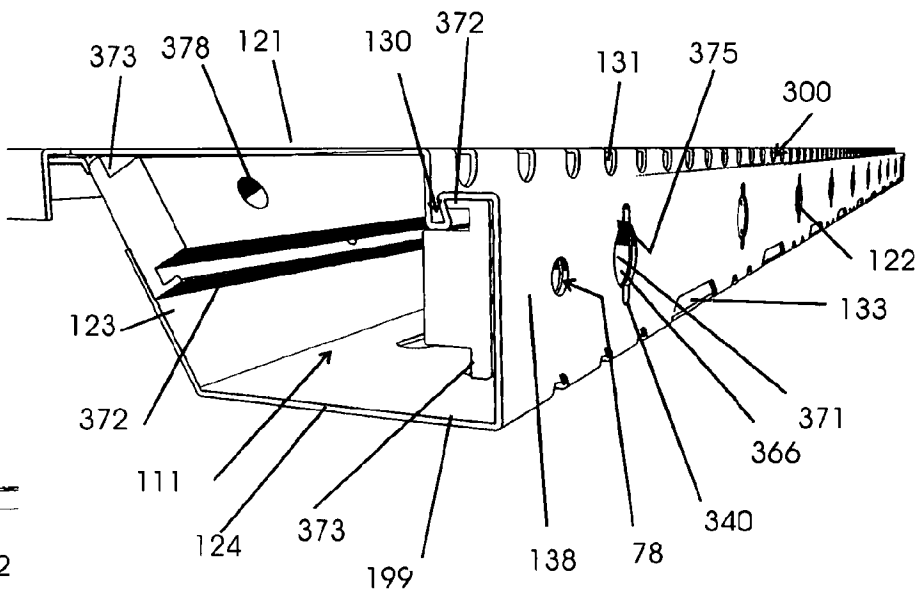
Figure 42:
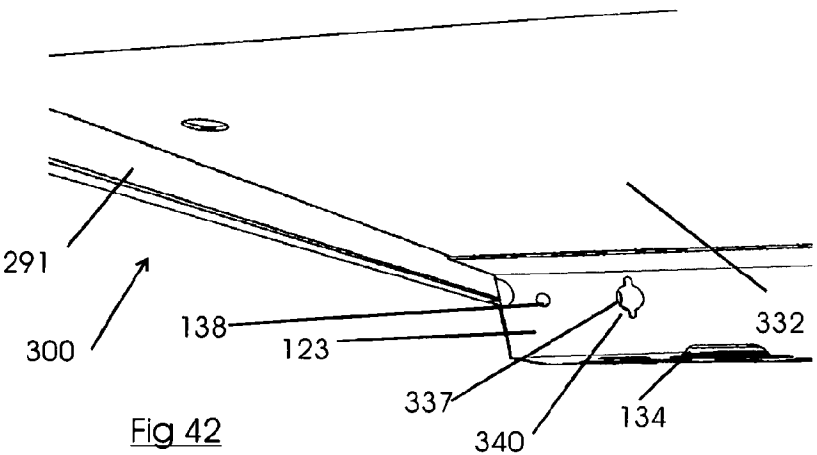
Figure 43:
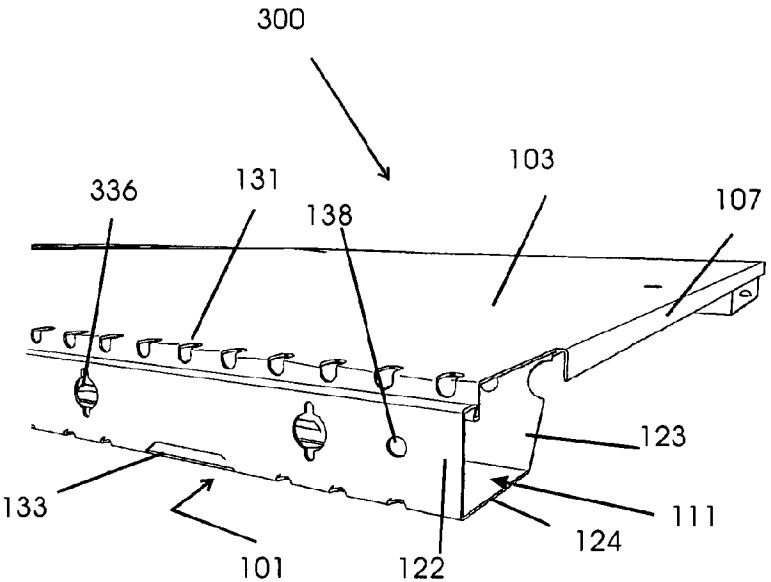
Figure 46:
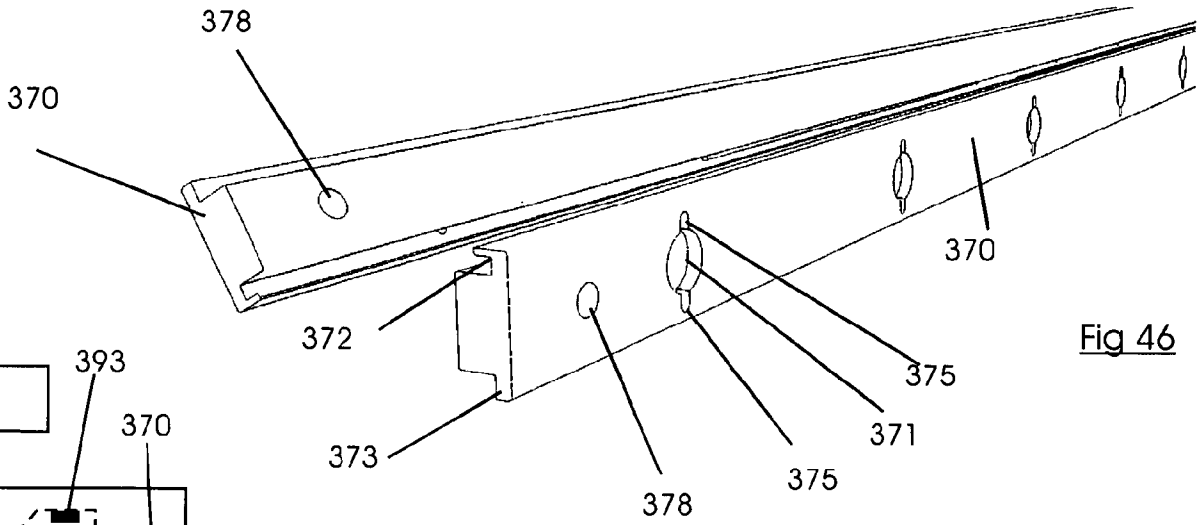
FIG. 46 shows a conductor strip for being used in combination with the shelves of FIG. 40.

As best shown in FIG. 46, a conductor strip 370 is provided comprising at least one electrical conductor embedded in an electrically insulating material. The conductor strip, being a plastic bar with build in electric wiring, comprises a number of sockets 371 for plugging in electronic devices to the at least one electrical conductor at the exterior of the first enclosed channel is provided in the first enclosed channel as shown in FIG. 40, FIG. 41 and FIG. 42. The sockets 371 are also substantially circular sockets having two slits 375. The shape of the socket matches the shape of the apertures 336 and 337. The first enclosed channel preferably extends over a majority of the front edge of the shelf, e.g. at least 70% or at least 80% or at least 90% or completely over the front edge of the shelf.

The conductor strip comprising sockets, each positioned in line with one of the plurality of apertures 336 in the second side 122 of the first channel or in line with one of the plurality of apertures 337 in the third side 123 of the first channel. The dimensions of the strip and the socket are chosen such that the socket does not disturb passage of objects through the apertures 131 and 132, nor though slits 133 and 134. The strips 370 may comprise a lip 372 which caused the strip to click at the ridge 130 at the inner side of the first channel 111. The shape of the ridge 130 and the shape of the lip 372 are made in such a way that a clicking engagement is made possible. Optionally the strip 370 is provided with a second lip 373 for reinforcing the strip profile and increase the bending resistance. The strip profile is made in such a way that the conductor strip makes contact with the inner surface of the at least one of the second and third side of the first enclosed channel. The inner surface of the at least one of the second and third side, e.g. the third side 123 may be provided with additional lips for providing additional support to the strip 370 and for improving the contact between strip 370 and inner surface of the third side 123. The strip may be fixed to the sides of the channel 111 by means of screws, screwed into the strip 370 through apertures 138. Facing the apertures 138, the strip may be provided with blind holes or apertures 378 having an inner wall with engaging screw thread.

Figure 47:
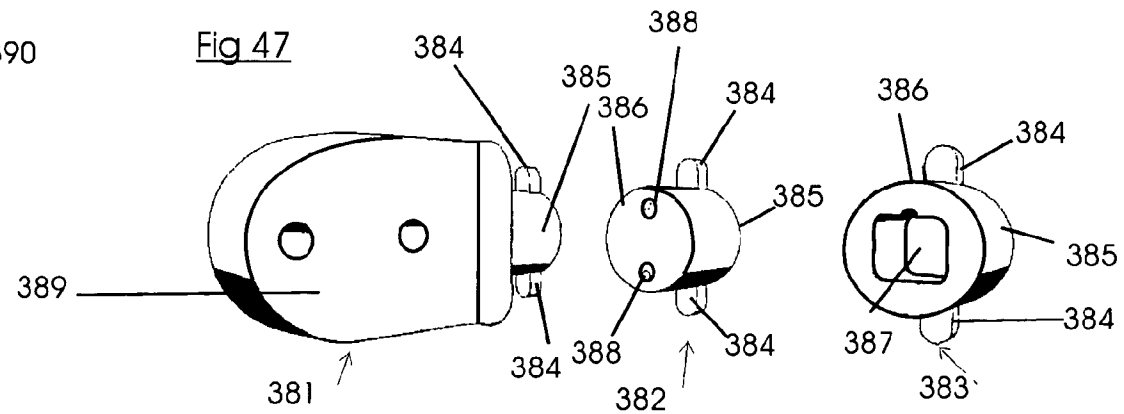
FIG. 47 shows plugs for being coupled to the conductor strips of FIG. 46.
Figure 48:
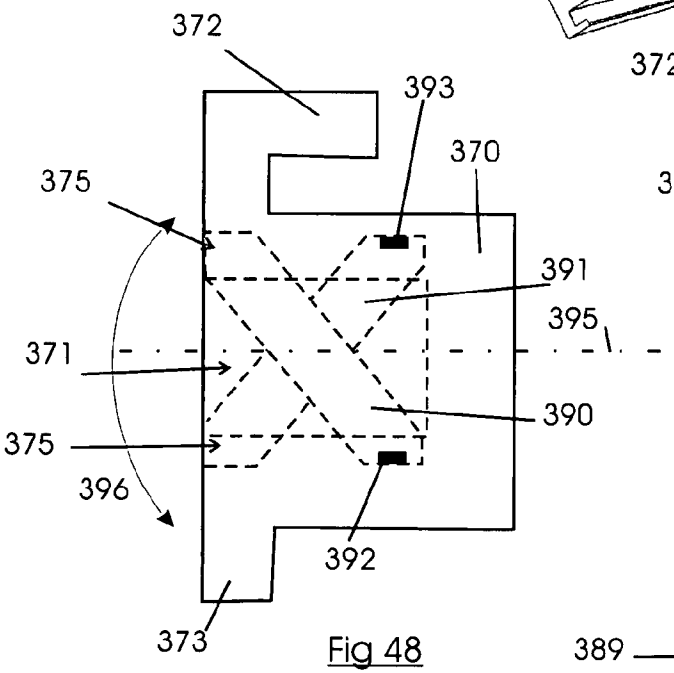
FIG. 48 show schematically the recesses ion the conductor strip of FIG. 46 in which the plugs of 47 are to be provided.

Plugs 381, 382 and 383 for being plugged in the sockets 371 are shown in FIG. 47. The plugs 381, 382 and 383 have a cylindrical outer surface 384 and are provided with two axially opposed electrically conductive fins 385. The outer surface and fins fit into the apertures 336 or 337 and the sockets 371. As shown schematically in FIG. 48, the strip 370 has internal recesses 390 and 291 allowing the plugs to be rotated about the axis 395 of the cylindrical surface in right hand direction as indicated 396, which axis 395 coincides with the axis of the aperture 336 or 337 and the axis of socket 371. Thereby the fins 385 is guided in the internal recesses 390 and 391 to make contact with the conductors 392 and 393 in the strip 370, when the plug is rotated about 180°. Simultaneously, by rotating the plug, the plug is prevented to leave the socket by the shape of the recess which shields the electrical conductors in the strip 370 from being exposes directly to the external environment. In such a way, the plug is not provided with electrical current during mounting of the plug into the recess.

Figure 49:
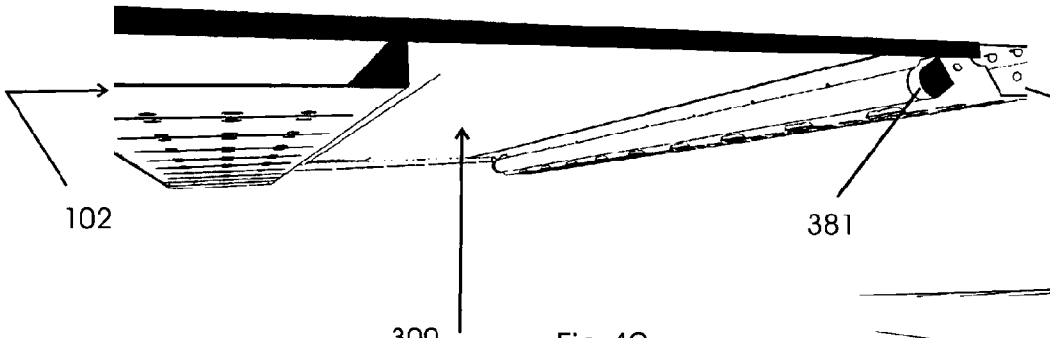
FIG. 49 shows a TL lamp coupled to the shelf of FIG. 40 using plugs of FIG. 47.

As shown in FIG. 47, a plug 383 has a recess 387 in its cylindrical body 386 for being coupled to an electronic device in general. Plug 383 is so-to-say an intermediate coupling element for coupling the electrical conductors in the strip 370 to the plug of the electrical device to be coupled to it. A plug 382 is a plug for coupling a halogen lamp having two connection pins. The plug 382 has two small recesses 388 in its cylindrical body 386 for receiving the two pins of a halogen lamp plug, which are to fit in the recesses 388. The plug 381 has a coupling means 389 for coupling the plug 381 to a TL lamp, such as shown in FIG. 49.

Figure 50:
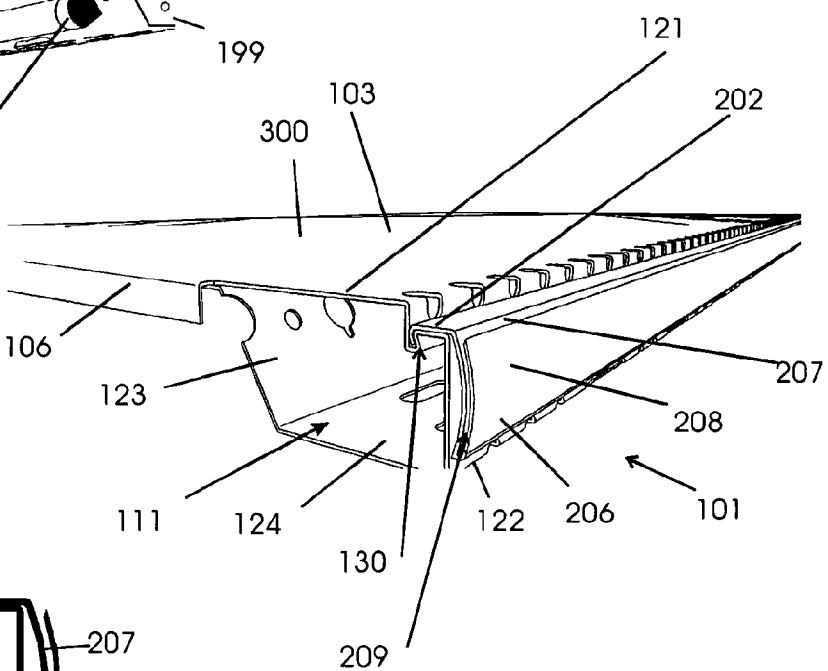
FIG. 50 and FIG. 51 shown a data strip coupled to a shelf of FIG. 40.
Figure 51:
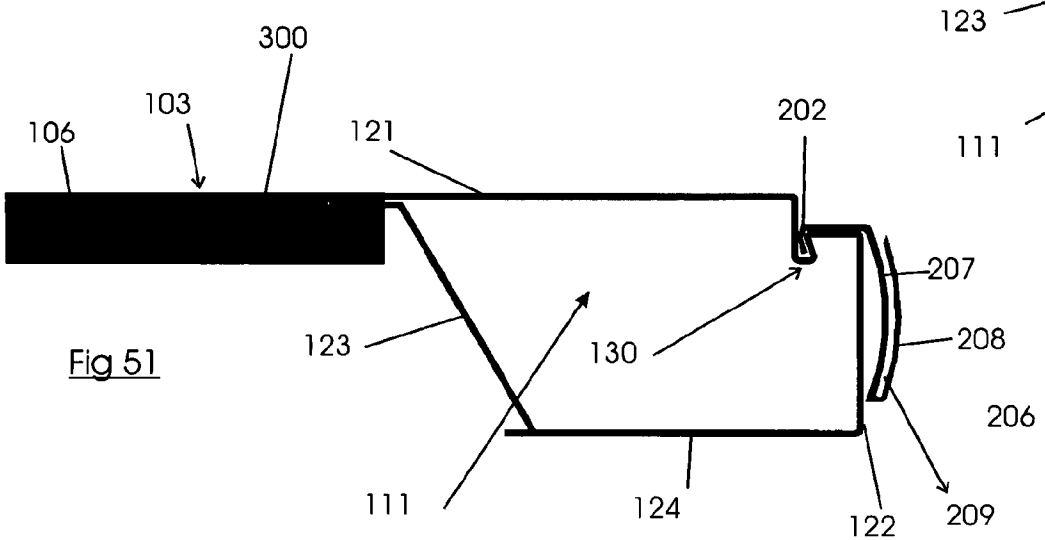
Figures 52, 53, 54:
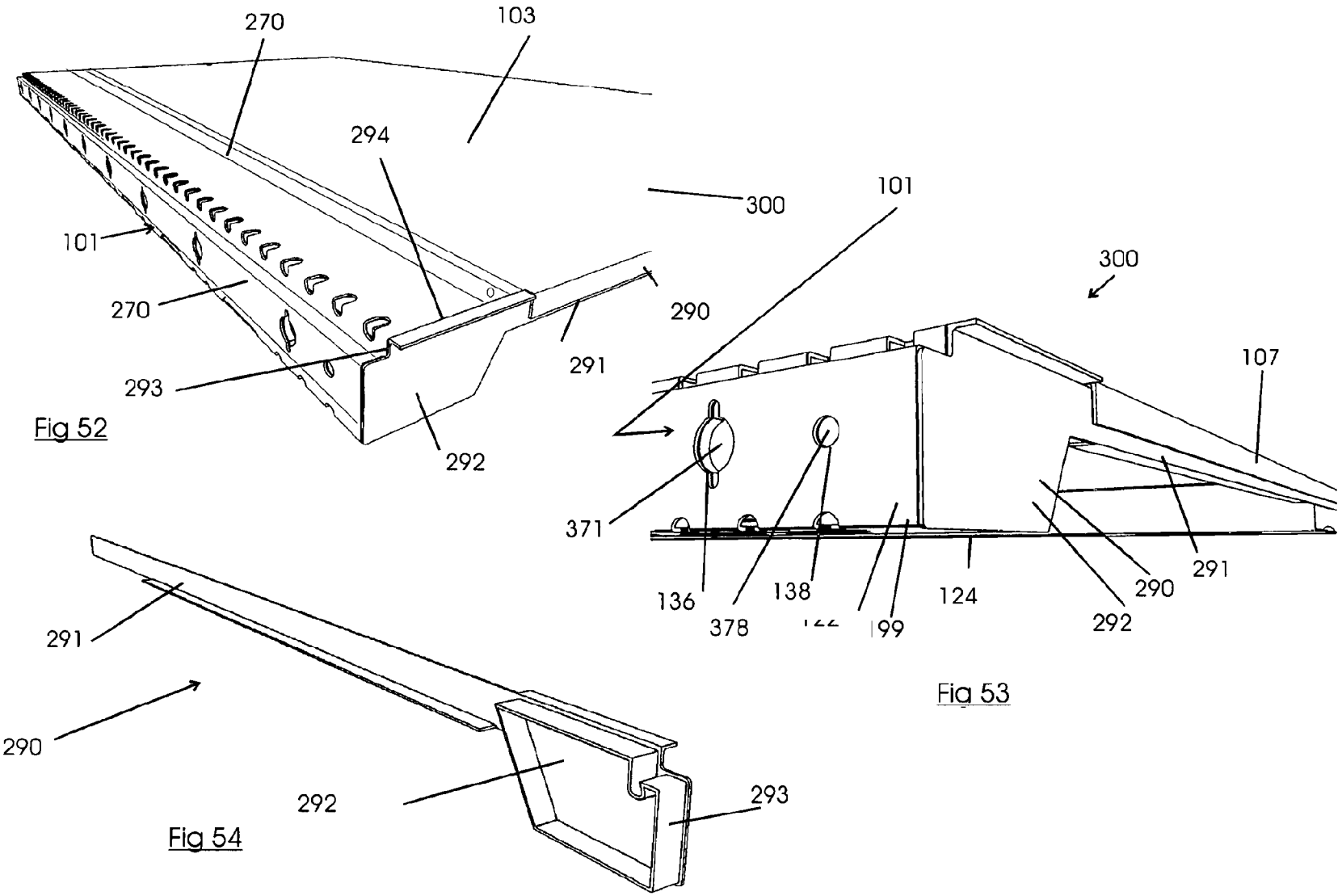
FIG. 52, FIG. 53 and FIG. 54 show a lid for closing the channels of a shelf as subject of embodiments of the present invention.
Figure 55:
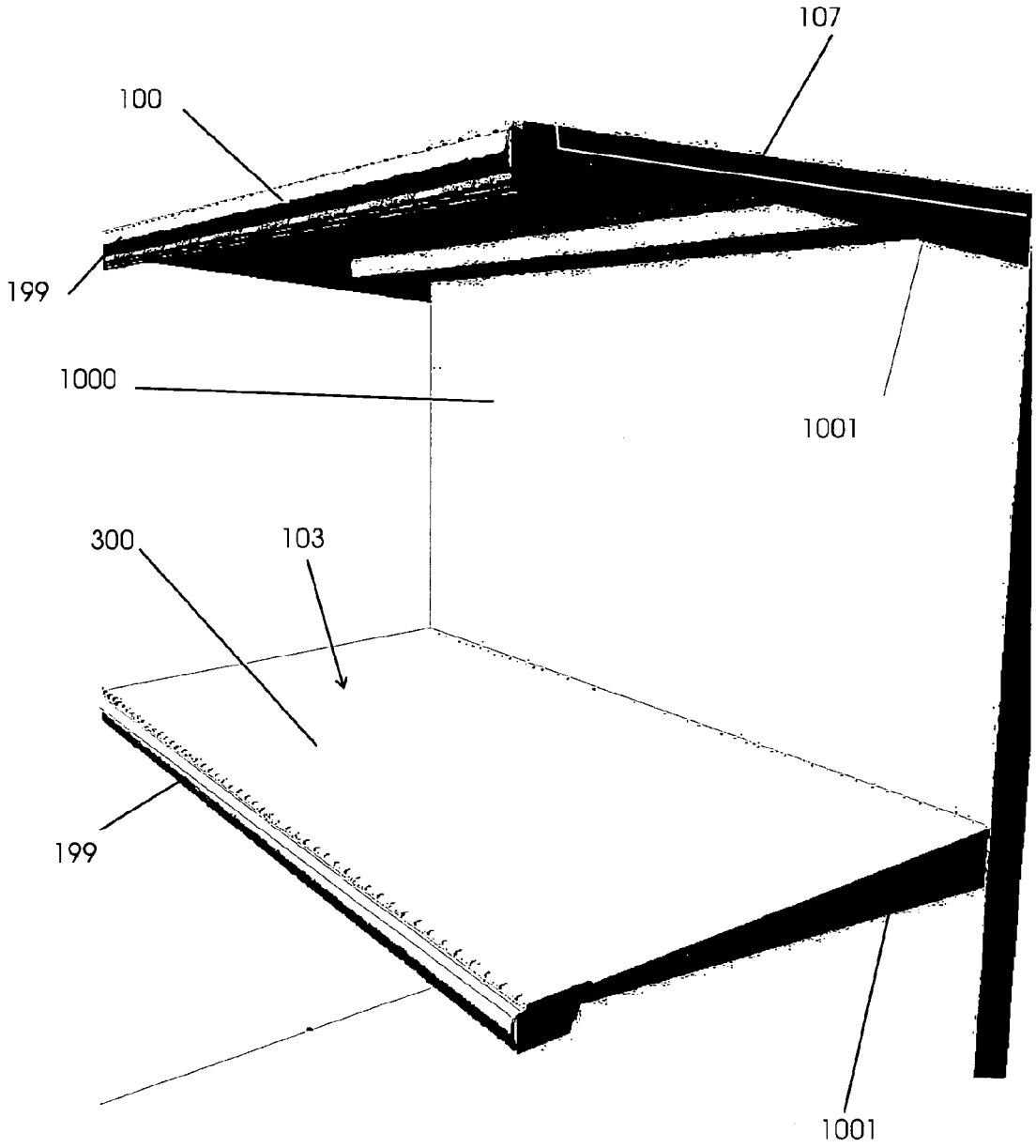
FIG. 55 and FIG. 56 show the shelf of FIG. 52 to FIG. 54 as part of a shelving unit.
Figure 56:
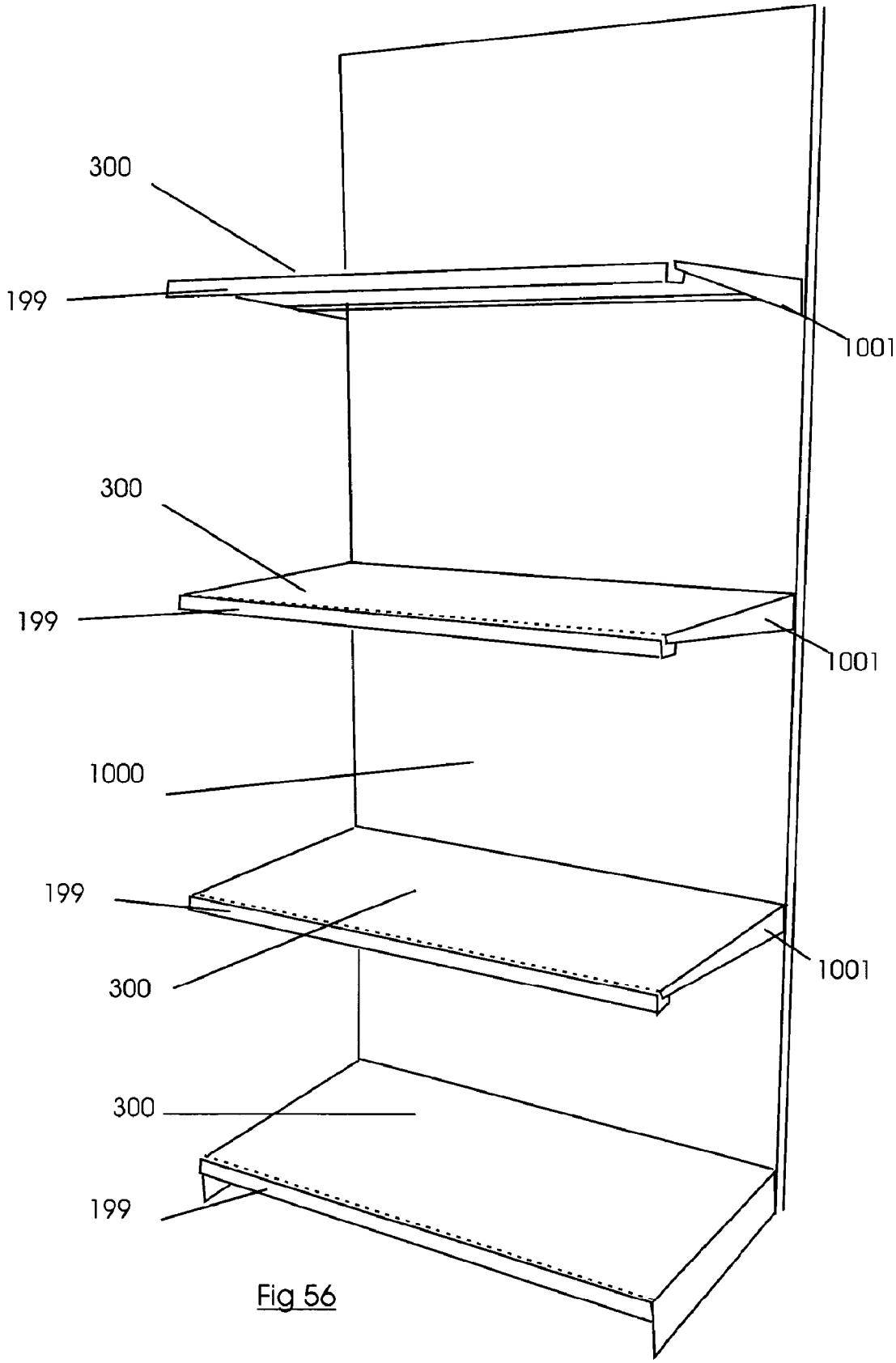

An alternative data strip 206 is shown in FIG. 50 and FIG. 51, which data strip 206 is mounted to a shelf 300. The data strip 206 is clipped by means of an identical or similar means for snap fitting 202 to the ridge 130. At its front side, the data strip has two substantially parallel surfaces 207 and 208, of which at least the outer surface 208 is made of transparent material. Informative cards can be inserted in the void 209 between the parallel surfaces 207 and 208.

It is understood that the data strip 206 may as well be provided to the shelf 100, replacing the data strip as shown in FIG. 12. it is also understood that the data strip as shown in FIG. 12 can be used in combination with shelf 300.

The use of the shelf 100, 200 or 300 as subject of the present invention to enable coupling of electronic devices guarantees a mechanically more rigid fixture of the device to the shelf, as the support is an integral part of the shelf itself. Also the cabling can be shielded from physical damage by means of the sides of the channels.

As shown in FIG. 52, FIG. 53, FIG. 54, FIG. 55 and FIG. 56 the shelves 300 as subject of the present invention may also comprise lids 290 to close the opening sides of the channels 111 and optionally the channels 112. The lids 290 are clamped between the lips 106 or 107, and the lateral supporting bar 1001 of the shelving unit 1000. The lateral closing lids 290 can completely close the channel and prevents entrance via the outer ends of the channels, so protecting the electrical and other components presenting the channel, and from influences of electrostatic charges build up on the shelf or the shelf unit, and possibly from EMI in case the shelf is made of electrically sufficiently conductive material. The lid 290 also provides a support for electrical wiring, e.g. cables, to and from the closed channel, so for electrical wiring are hidden, even tucked away out of reach and sight of consumers. A lid for each channel opening of the first or second channel may be provided, or one lid 290 for closing both the openings of both the first and second channel at one particular side of the channel may be provided. The lid has a covering side 292 and a insert part 293 to be inserted in the channel. The insert part 293 engages closely the inner wall 294 of the channel the lid may have a part 291 extending along the lip 107.

It is understood that a similar or identical lid may be provided for the shelves 100 and 200 as subject of the present invention.

It is to be understood that although preferred embodiments, specific constructions and configurations, as well as materials, have been discussed herein for devices according to the present invention, various changes or modifications in form and detail may be made without departing from the scope and spirit of this invention. As an example, a shelving unit 1000 can be provided comprising a multitude of shelves 100, 200 and/or 300 having one or more features as set out above.

The invention claimed is:

1. An advertising display shelf for carrying and displaying products and for displaying display elements on a front edge, the shelf being made of sheet material, and comprising a front edge and a back edge and a load carrying flat portion, the front edge comprising a support for supporting display elements of a display system, wherein the sheet material at the front edge is formed as a first enclosed channel integrally formed with the load carrying flat portion, the first enclosed channel being cylindrical or tubular and providing the support at the front edge of the shelf, the support having a plurality of apertures for attaching the display elements.

2. An advertising display shelf according to claim 1 wherein the first enclosed channel extends over all of the front edge of the shelf or wherein the first enclosed channel extends over at least 70% of the front edge of the shelf.

3. An advertising display shelf according to claim 1, wherein the plurality of apertures are adapted for mounting a plurality of POS display elements selected from the group consisting of a wobbler, a label, a product holder, a side banner, a flag, a sign, a shelf divider, a shelf extender, a shelf talker, an aisle divider, an electronic price tag, a touch screen display, an LCD screen, an electronic devices and an electronic bascules.

4. An advertising display shelf according to claim 1, wherein the first enclosed channel is provided with at least one electrical conductor.

5. An advertising display shelf according to claim 4, wherein the at least one electrical conductor is embedded in an electrically insulating material thus forming a conductor strip.

6. An advertising display shelf according to claim 1, the first enclosed channel having an inner void, wherein the inner void of the first enclosed channel is electrostatically shielded or electrostatically screened by said sheet material.

7. An advertising display shelf according to claim 1, wherein the sheet material at the back edge is formed as a second enclosed channel.

8. An advertising display shelf according to claim 7, wherein the second enclosed channel has mounting means for mounting display elements.

9. An advertising display shelf according to claim 8, wherein the mounting means of the second enclosed channel comprise a plurality of apertures.

10. An advertising display shelf according to claim 1, wherein the first enclosed channel has at least a first side being part of the load carrying flat portion, a second side providing the front side of the support and a third side facing towards the back edge of the shelf.

11. An advertising display shelf according to claim 10, wherein the cross-section of the first channel is substantially quadrangular and includes a fourth side being substantially parallel with the first side.

12. An advertising display shelf according to claim 10, the first enclosed channel having an inner void, wherein the inner void of the first enclosed channel is electrostatically shielded or electrostatically screened by said sheet material; wherein the conductor strip makes contact with the inner surface of the at least one of the second and third sides of the first enclosed channel.

13. An advertising display shelf according to claim 10, wherein the first enclosed channel is provided with at least one electrical conductor; wherein the conductor strip is attached to any of the sides of the enclosed channel.

14. An advertising display shelf according to claim 13, wherein the conductor strip is screw mounted.

15. An advertising display shelf according to claim 10, wherein the first enclosed channel is provided with at least one electrical conductor; wherein the at least one of the second and third sides of the first enclosed channel is provided with a plurality of apertures, the conductor strip comprising at least one socket positioned at one of the plurality of apertures for allowing coupling of an electronic device to the at least one electrical conductor.

16. An advertising display shelf according to claim 1, wherein along the front edge, the sheet material is provided with at least one ridge for providing a snap fit to a datastrip along the front side of the support.

17. A shelving unit for carrying products for display, comprising at least one advertising display shelf according to claim 1.

18. A shelving unit according to claim 17, furthermore comprising at least one interchangeably connectable display element mounted at one of the apertures of one of the advertising display shelves.

19. A method of manufacturing an advertising display shelf suitable for carrying products on the shelf and for displaying display elements on the front edge, the method comprising:

providing sheet material, forming from the sheet material a front edge and a load carrying flat portion, the front edge comprising a support for supporting display elements, wherein forming the front edge comprises integrally forming with the load carrying flat portion a first enclosed channel and providing apertures in the front edge for attaching the display elements, the first enclosed channel being tubular or cylindrical.

20. A method according to claim 19, wherein making apertures comprises laser cutting apertures.

21. A method according to claim 19, wherein forming the front edge comprises forming the first enclosed channel over all of the front edge or wherein forming the front edge comprises forming the first enclosed channel over at least 70% of the front edge.

* * * * *